US012446649B2

(12) United States Patent
Olivares Velasco

(10) Patent No.: US 12,446,649 B2
(45) Date of Patent: Oct. 21, 2025

(54) TEMPERATURE REGULATING HELMET SYSTEM AND METHODS THEREOF

(71) Applicant: Federico Olivares Velasco, Cranberry Township, PA (US)

(72) Inventor: Federico Olivares Velasco, Cranberry Township, PA (US)

( * ) Notice: Subject to any disclaimer, the term of this patent is extended or adjusted under 35 U.S.C. 154(b) by 0 days.

(21) Appl. No.: 18/609,009

(22) Filed: Mar. 19, 2024

(65) Prior Publication Data

US 2024/0315384 A1 Sep. 26, 2024

Related U.S. Application Data

(60) Provisional application No. 63/454,401, filed on Mar. 24, 2023.

(51) Int. Cl.
*A42B 3/28* (2006.01)
*A42B 3/06* (2006.01)

(52) U.S. Cl.
CPC ..... *A42B 3/285* (2013.01); *A42B 3/063* (2013.01)

(58) Field of Classification Search
CPC ..... A42B 3/285; A42B 3/063; A42B 3/286; A62B 18/045
See application file for complete search history.

(56) References Cited

U.S. PATENT DOCUMENTS 2,391,335 A 12/1945 O'Brien
4,280,491 A * 7/1981 Berg ..... A42B 3/288 55/DIG. 35
5,009,225 A * 4/1991 Vrabel ..... A62B 18/006 128/202.19
5,978,593 A 11/1999 Sexton
6,397,399 B1 6/2002 Lampe et al.
6,438,761 B1 8/2002 McGarrity
8,613,114 B1 12/2013 Olivares Velasco
(Continued)

FOREIGN PATENT DOCUMENTS

CN 112471664 A 3/2021
CN 216363840 U 4/2022
(Continued)

OTHER PUBLICATIONS

Thomas, Shane; International Search Report and Written Opinion of the International Searching Authority; Int'l. Pat. App. No. PCT/US2024/020683; Aug. 6, 2024; 12 pages.

*Primary Examiner* — Tajash D Patel
(74) *Attorney, Agent, or Firm* — Frost Brown Todd LLP

(57) ABSTRACT

A helmet system includes an outer protective shell defining an inner cavity and an inner protective system positioned within the inner cavity. The inner protective system has a padding layer coupled to the outer protective shell. The helmet system also includes a temperature regulation system that has at least one temperature regulation element, a power source configured to provide electrical power to at least one temperature regulation element, and a sensor configured to generate an output signal based on a sensed temperature. The temperature regulation system also has a processor in communication with the sensor and the processor is configured to provide electrical power to at least one temperature regulation element responsive to the output signal exceeding a temperature threshold.

30 Claims, 22 Drawing Sheets

(56) References Cited

U.S. PATENT DOCUMENTS

| | | | | |
|---|---|---|---|---|
| 8,756,715 | B1 * | 6/2014 | Moffitt, Jr. | A42B 3/24 2/171.3 |
| 8,763,166 | B1 | 7/2014 | Olivares Velasco | |
| 8,819,869 | B2 * | 9/2014 | VanDerWoude | A42B 3/225 2/410 |
| 8,997,265 | B2 | 4/2015 | Olivares Velasco | |
| 9,775,396 | B1 | 10/2017 | Olivares Velasco | |
| 10,172,406 | B2 | 1/2019 | Olivares Velasco | |
| 10,653,199 | B2 | 5/2020 | Olivares Velasco | |
| 11,266,195 | B2 | 3/2022 | Olivares Velasco | |
| 11,478,030 | B2 | 10/2022 | Olivares Velasco et al. | |
| 11,484,085 | B1 * | 11/2022 | Grady | A42B 3/0406 |
| 11,606,998 | B2 | 3/2023 | Olivares Velasco | |
| 11,744,302 | B2 | 9/2023 | Olivares Velasco et al. | |
| 2003/0031687 | A1 | 2/2003 | Falder et al. | |
| 2005/0193477 | A1 | 9/2005 | Penny | |
| 2005/0193742 | A1 | 9/2005 | Arnold | |
| 2006/0005291 | A1 * | 1/2006 | Bedford | A42B 3/285 2/171.2 |
| 2006/0101556 | A1 * | 5/2006 | Goldsborough | A42B 3/285 2/424 |
| 2008/0155991 | A1 * | 7/2008 | Lee | A42B 3/285 62/3.2 |
| 2010/0005572 | A1 * | 1/2010 | Chaplin | A42B 3/285 165/185 |
| 2010/0095439 | A1 * | 4/2010 | Nolan | A42B 3/286 2/15 |
| 2011/0078845 | A1 * | 4/2011 | McKinney | A42B 3/285 2/422 |
| 2012/0096631 | A1 | 4/2012 | King et al. | |
| 2014/0130240 | A1 | 5/2014 | Olivares Velasco | |
| 2015/0173445 | A1 * | 6/2015 | Gordon | F25B 21/04 62/3.3 |
| 2016/0302500 | A1 | 10/2016 | Johnston | |
| 2017/0332715 | A1 | 11/2017 | Abraham | |
| 2020/0077730 | A1 | 3/2020 | Blaxter, III et al. | |
| 2020/0275722 | A1 | 9/2020 | Higuchi | |
| 2020/0375793 | A1 | 12/2020 | Dilligan et al. | |
| 2022/0047034 | A1 * | 2/2022 | Krishnan | A42B 3/285 |
| 2023/0142431 | A1 | 5/2023 | Olivares Velasco | |
| 2023/0225444 | A1 | 7/2023 | Olivares Velasco | |
| 2023/0404191 | A1 | 12/2023 | Olivares Velasco et al. | |

FOREIGN PATENT DOCUMENTS

| | | | | |
|---|---|---|---|---|
| EP | 0772106 | A1 | 5/1997 | |
| EP | 3846653 | A1 | 7/2021 | |
| EP | 3941599 | A1 | 1/2022 | |
| JP | 2022525378 | A | 5/2022 | |
| MX | 2021011274 | A | 12/2021 | |
| WO | 2005000057 | A2 | 1/2005 | |
| WO | 2014018613 | A1 | 1/2014 | |
| WO | WO-2017120627 | A1 * | 7/2017 | A42B 3/285 |
| WO | 2020051404 | A1 | 3/2020 | |
| WO | 2020190918 | A1 | 9/2020 | |
| WO | WO-2023175624 | A1 * | 9/2023 | A42B 3/286 |

* cited by examiner

TEMPERATURE REGULATING HELMET SYSTEM AND METHODS THEREOF

REFERENCE TO RELATED APPLICATION

This application claims priority of U.S. provisional patent application Ser. No. 63/454,401 filed Mar. 24, 2023, titled TEMPERATURE REGULATING HELMET SYSTEM AND METHODS THEREOF, which is hereby incorporated by reference herein in its entirety.

BACKGROUND

Helmets are often used by individuals to protect themselves against physical injury, whether a result of playing sports, recreational activities (i.e. athletes, motorcycle riders), industrial workplace risks or due to an occupational hazard (i.e. fire fighter or army personnel). Such helmets conventionally are made from one or more types of protective materials. Depending on the environmental conditions in which the helmet is being worn, however, the performance of the protective materials may be negatively impacted. Accordingly, there exists a need in the art to maintain the performance of helmets across a range of environmental conditions.

BRIEF DESCRIPTION OF THE DRAWINGS

It is believed that certain embodiments will be better understood from the following description taken in conjunction with the accompanying drawings in which.

DETAILED DESCRIPTION

Figure 1:
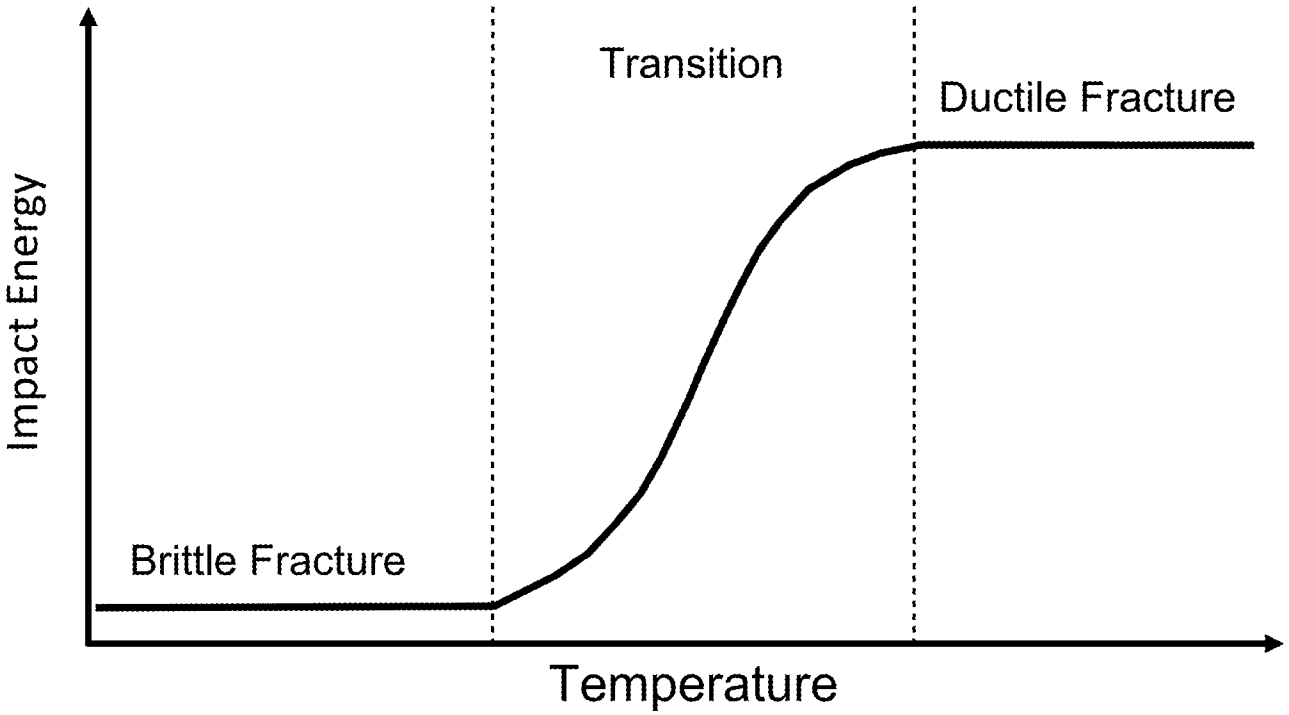
FIG. 1 shows a plot of a ductile/brittle transition temperature (DBTT) for an example material.

Various non-limiting embodiments of the present disclosure will now be described to provide an overall understanding of the principles of the structure, function, and use of systems, apparatuses, devices, and methods disclosed. One or more examples of these non-limiting embodiments are illustrated in the selected examples disclosed and described with reference made to FIGS. 1-45 in the accompanying drawings, wherein like numbers indicate the same or corresponding elements throughout the views. Those of ordinary skill in the art will understand that systems, apparatuses, devices, and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

The examples discussed herein are examples only and are provided to assist in the explanation of the apparatuses, devices, systems, and methods described herein. None of the features or components shown in the drawings or discussed below should be taken as mandatory for any specific implementation of any of these apparatuses, devices, systems, or methods unless specifically designated as mandatory. For ease of reading and clarity, certain components, modules, or methods may be described solely in connection with a specific figure. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such. Any failure to specifically describe a combination or sub-combination of components should not be understood as an indication that any combination or sub-combination is not possible. It will be appreciated that modifications to disclosed and described examples, arrangements, configurations, components, elements, apparatuses, devices, systems, methods, etc. can be made and may be desired for a specific application. Also, for any methods described, regardless of whether the method is described in conjunction with a series of steps or a flow diagram, it should be understood that unless otherwise specified or required by context, any explicit or implicit ordering of steps performed in the execution of a method does not imply that those steps must be performed in the order presented but instead may be performed in a different order or in parallel.

Reference throughout the specification to "various embodiments," "some embodiments," "one embodiment," "some example embodiments," "one example embodiment," or "an embodiment" means that a particular feature, structure, or characteristic described in connection with the embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The presently disclosed embodiments are generally directed to temperature regulation systems for helmets, helmets that have temperature regulation systems, methods of using a temperature regulation system with a helmet, and methods of manufacturing helmet systems. Such systems and methods may be implemented in a wide variety of contexts and applications. Example helmets can be constructed with one or more layers, shells, sections, rows, columns, lattices, geometries, pads, discs, structures, turbines, tubes, or pockets of impact absorbing, impact mitigating or impact dissipating materials, which may be referred to generally herein as protective material, protective layers, or a protective system. These features can have a wide array of geometries, structures, and configurations. The particular type, size, placement, and structure of the protective material can vary based on a variety of factors, such as style of helmet, sporting or athletic application, age of user, type of user, size of helmet, and so forth.

As is to be appreciated, helmets in accordance with the present disclosure can be any of a wide variety of helmet types, such as ski helmets, snowboard helmets, skateboard helmets, luge helmets, skeleton helmets, bobsled helmets, American football helmets, cycling and commuter helmets, motorcycle helmets, hockey helmets, lacrosse helmets, cricket helmets, rugby helmets, hiking helmets, rock climbing helmets, equestrian helmets, baseball helmets, softball helmets, industrial protection helmets, law enforcement helmets, military helmets, astronaut helmets, firefighting helmets, search and rescue helmets, forestry helmets, automotive helmets, recreational use helmets, and so forth.

In hot weather or high temperatures, some protective materials of a helmet can soften and, as a result, fail to provide their maximum or otherwise optimized protection. In cold weather or low temperatures, some protective materials of a helmet can harden and, as a result, fail to provide their maximum or otherwise optimized protection. In accordance with the present disclosure, a helmet having an automated temperature regulation system is provided that can regulate and control the temperature of the different protective materials and components of the helmet. Such automated temperature regulation system can seek to achieve the optimal and maximum protective performance of the different protective materials and components of the helmet, regardless of the weather or other environmental conditions. Accordingly, in some embodiments, the temperature regulation system can function to cool protective materials of the helmet in warm environmental temperatures based on various control methodologies. In some embodiments, the temperature regulation system can heat materials of the protective materials in cold environmental temperatures. In some embodiments, the temperature regulation system can selectively heat or cool the protective materials, depending on the environmental conditions.

Moreover, in accordance with the present disclosure, the temperature regulation system can seek to individually regulate the temperature of one or more specific components of a helmet, such as an outer protective shell and/or one or more inner protective components. Such temperature regulation can be based on specific performance data associated with the materials used in the manufacturing of specific components of the helmet. Additionally, or alternatively, the temperature regulation system can seek to regulate the entire structure of the helmet (or nearly the entire structure), including the outer layer/shell, an inner liner layer, and any additional protective layers or materials positioned therebetween.

In some embodiments, depending on the structure or material of the various components of the helmet, a plurality of different heating/cooling profiles can be used within a single helmet, each of which can be selectably implemented based on real-time use. By way of example, a first component may be manufactured from a rigid material that is known to be especially susceptible to becoming brittle in cold temperatures, while a second component may be a pliable, semi-rigid material that is known to only become brittle in extremely cold temperatures. In such an arrangement, the temperature regulation system can apply heat to the first component once a first temperature threshold is detected and only apply heat to the second component once a second, colder temperature threshold is detected. Such an approach can beneficially serve to maintain the longevity of an associated power source, for example, while still seeking to keep various materials of the helmet within certain temperatures ranges so that such materials can continue to provide their designed protective function when worn by a user.

Moreover, some embodiments of the temperature regulation system may be integrated into or between layers or components, which, by using chemical and material-based properties, are able to cool or heat separate layers of the helmet, the entire helmet, or the user's head. Various embodiments can make use of any of a variety of chemicals, such as ethylene glycol, frozen or cooled packs, menthol and methyl salicylate coating, and iron oxidation (as found in air-activated hand warmers), for example. Some embodiments can additionally, or alternatively, use any of a variety of materials or coatings, such as exothermic resins, carbon fibers, PBT PC, fiber additives, Ultem, black/Vanta black paint (to absorb heat), expanded polystyrene foam, aerogel blanket, and thermal transfer padding, for example. As is to be appreciated, various embodiments may utilize one or multiple of these chemicals and materials to achieve the desired results.

The response to impact behavior of various protective materials of a helmet can be strongly dependent upon the temperature. At low or cold temperatures, some materials that would be ductile at room temperature become brittle. Brittleness indicates that the protective material absorbs relatively little energy during fracture. Moreover, at high or warm temperatures, some materials are more ductile and have high impact toughness. The ductility of a material is its ability to deform under load. Moreover, the ductile/brittle transition temperature (DBTT) is the transition temperature below which a ductile plastic specimen becomes brittle. More specifically, it is the temperature when the ductile/brittle transition occurs such that it is the boundary between brittle and ductile behavior, as shown in FIG. 1. Conventionally, the DBTT is not necessarily a specific temperature but rather a temperature spread over a 10° C. range, shown as the transition range in FIG. 1. The brittle-to-ductile transition is an example thermal property to consider as it informs the understanding of part failure processes (fatigue, overload, or environmental stress cracking). Moreover, when cooling a material, the DBTT may not necessarily correspond to the DBTT observed on heating of the same material.

In accordance with the present disclosure, various approaches can be used to regulate the temperature of various protective materials of a helmet, based on the DBTT for the protective material. For example, one or more embedded conductive layers, structures or components can be sandwiched or placed between one or more different protective layers or structures of the helmet or otherwise coupled thereto. In some embodiments micro wires or powered coils can be placed proximate to the protective materials and/or embedded into fabrics of the protective materials. In some embodiments, heating and cooling materials can include various chemicals, coatings, foils, gels, inks, films, liquids, metals, resins, sheets, tapes, paraffin wax, hydrated salts, acids, eutectics, plastics, and so on. In some embodiments, the helmet can include air bladders, ventilated liners, temperature phase changing materials (PCM), and vents in the outermost core of the helmet to assist with temperature regulation.

Various electronic activated components in accordance with the present disclosure can be employed in some embodiments, including, but not limited to, Peltier modules for cooling and/or heating, thermoelectric coolers, Phase Change Materials (PCMs), resistive wiring, lighting elements such as incandescent/CFL/UV/Halogen/LED/OLED, and low-level non-ionizing radiation. The temperature regulating elements can be continuous, discontinuous, or clustered throughout the helmet. In some embodiments, a plurality of different types of heating sources or cooling sources can be deployed throughout a single helmet, for example.

The systems and methods described herein may utilize various cooling technologies in order to maintain desired ductile temperature during operating conditions with elevated temperatures, which can include extreme heat circumstances, for example. These technologies can include, but are not limited to, the Peltier modules for cooling, thermoelectric coolers, Phase Change Materials (PCMs), liquid circulation with cooling fluid, electroactive polymers (Leaps) to adjust airflow, Dielectric electro active polymers, active ventilation systems leveraging fans and blowers, flexible blades or benders, and synthetic jets, Electrostatic fluid accelerators (EFA), electrohydrodynamics (EHD) air mover, ionic wind pump, ionic wind engine, corona wind pump, and plasma fan, fabrics with cooling properties.

Figure 43:
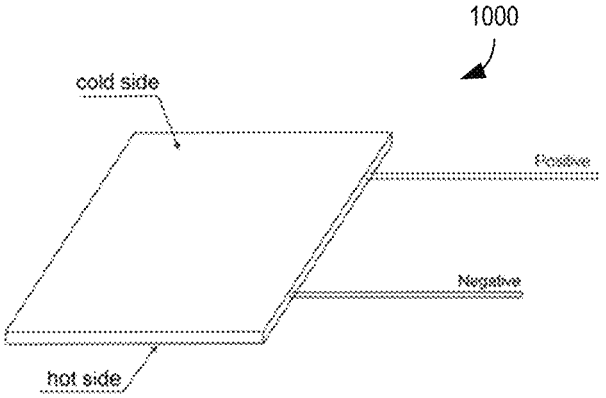
FIG. 43 depicts an example Peltier module.

Peltier modules, also known as thermoelectric coolers (TECs), are solid-state devices that convert electrical energy into thermal energy. They conventionally include two different types of semiconductors, typically bismuth telluride (Bi2Te3), which are optimized for either p-type (positive charge carriers) or n-type (negative charge carriers) conduction. These semiconductors are connected electrically in series and thermally in parallel, with copper or other conductive materials used to create the electrical junctions between them. The semiconductors and electrical connections are sandwiched between two ceramic plates, which provide electrical insulation and mechanical support. When a DC current is applied to the Peltier module, one side becomes hot and the other cold due to the Peltier effect. The hot and cold sides can be switched by reversing the current direction. An example Peltier module 1000 is schematically depicted in FIG. 43.

The operation of a Peltier module relies on the application of a DC voltage, which causes electrons to flow from the n-type semiconductor to the p-type semiconductor. As electrons move from a low-energy level in the p-type semiconductor to a higher energy level in the n-type semiconductor, they absorb heat energy from the surrounding environment, resulting in the cooling of one side of the Peltier module, referred to as the "cold side." The electrons continue to flow through the semiconductor materials and release the absorbed heat energy on the opposite side of the module, known as the "hot side."

Using Peltier modules as a temperature regulation element for a helmet system in accordance with the present disclosure can have several potential advantages, such as high energy efficiency, safety, and flexibility. Peltier modules offer precise temperature control and can provide uniform heating. Additionally, Peltier modules do not produce emissions or use flammable materials, making them safer and more environmentally friendly than traditional heating technologies. They also have the advantage of being compact in size, lightweight, and reliable due to the absence of moving parts.

Figure 44:
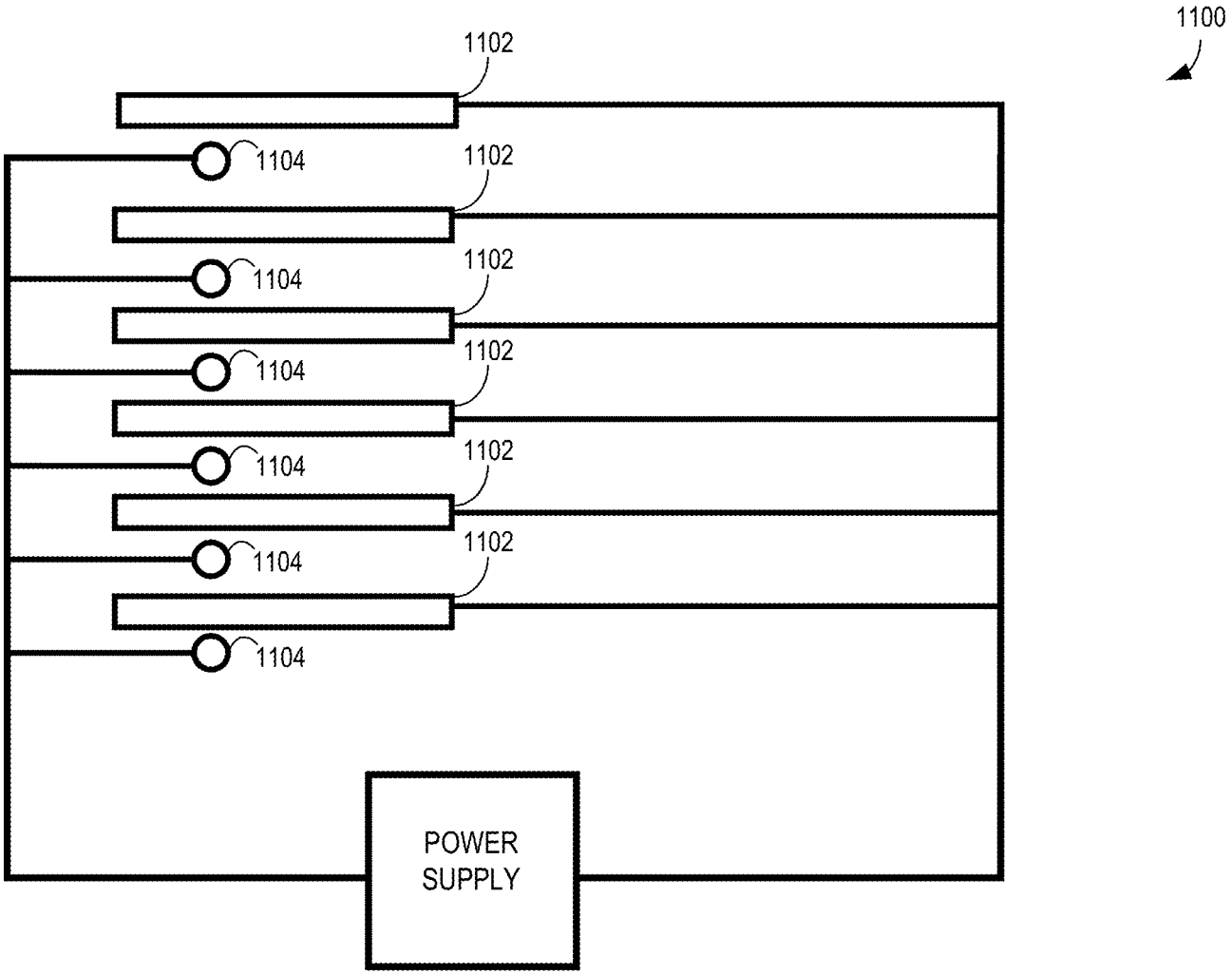
FIG. 44 depicts an example Electrostatic fluid accelerator (EFA).

Electrostatic fluid accelerators (EFAs) are another example temperature regulation element in accordance with the present disclosure which can provide airside thermal management solutions for advanced microelectronics because they have no mechanical moving parts, have ultra-thin and small form factor structure, and can fit in small physical spaces where other mechanical technologies cannot. As shown in FIG. 44, an EFA 1100 has multiple closely spaced corona electrodes 1104. The close spacing of the corona electrodes is obtainable because the corona electrodes are isolated from each another with exciting electrodes 1102. The exciting electrode 1102 must be placed asymmetrically between adjacent corona electrodes 1104 or an accelerating electrode must be engaged.

Systems and methods in accordance with the present disclosure can utilize various temperature regulation elements to provide controlled heat to maintain desired ductile temperature in cold operational conditions, including extreme cold circumstances, for example. These temperature regulation elements can include, but are not limited to the Peltier Effect heating, Phase Change Materials (PCMs), heat absorbing coatings in outermost portion of the helmet, thermal insulation materials, thermal conductive sheets, conductive materials, textiles, carbon fiber filament and other types of electrical sheets, resistive wiring, lighting technologies (such as incandescent, CFL, UV, Halogen, LED, OLED), low-level non-ionizing radiation, and even emitted heat from the battery, electronic components or power source.

Figure 42:
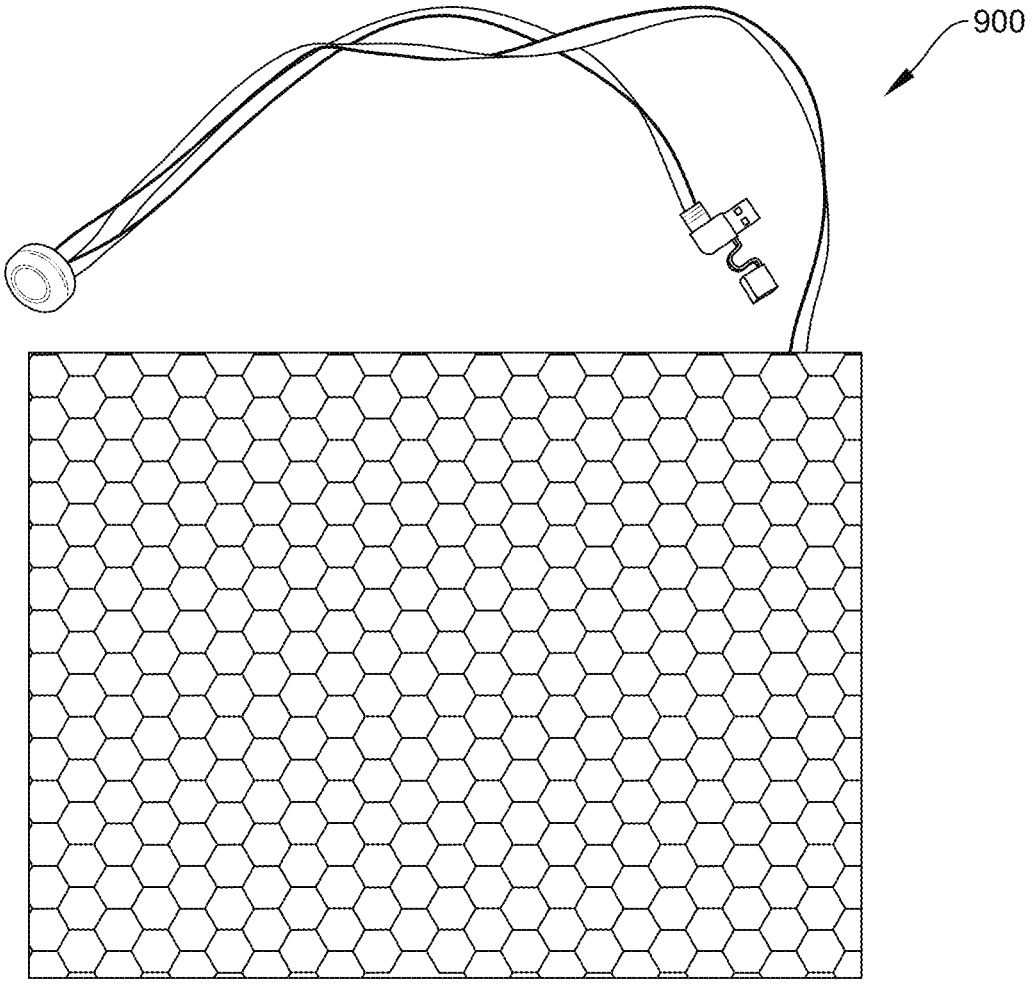
FIG. 42 depicts an example electric sheet heating element.

By way of example, some embodiments can use an electrical sheet heating system that includes at least one electric sheet-type heating element made of flexible high-resistivity material to which the main electrodes are connected. An example electric sheet heating system 900 is illustrated in FIG. 42. The electric sheet heating system 900 can utilize a generally flat, flexible heating element made of a high-resistance material, typically in a sheet or mat form. The heating element can be made of a flexible material with high electrical resistivity, such as carbon fibers, conductive polymers, or metal alloy wires woven into a fabric or mesh. This high-resistance material allows it to generate heat efficiently when an electric current passes through it, as the resistance to the flow of electrons causes the material to heat up. The heating element can have main electrodes or electrical connections attached to it. When these electrodes are connected to a power source of a temperature regulation system, they allow an electric current to flow through the high-resistance heating element material, causing it to heat up. The flexibility of the sheet heating element enables it to be bent, rolled, or shaped to conform to various surfaces or features for installation into a helmet. The electric sheet heating system 900 can distribute heat uniformly, while providing flexibility in installation and energy efficiency.

Some of the technologies described herein can further aid with heat management, heat dissipation or heat transfer. One example is thermal conductive sheets, which are also referred to as heat dissipation sheets. Thermal conductive sheets can be made of silicon, acrylic resin, carbon fiber, and other materials. Another heat dissipation example is flexible blades or benders that can be activated to create an airflow for dissipating heat. Another example technology that can be incorporated into the helmet systems described herein is vapor Chambers, which can help with heat management for miniaturized electronic devices with increased inner components. Another example technology that can be incorporated into the helmet systems described herein is heat sinks. A heat sink usually consists of a metal structure with one or more flat surfaces to ensure good thermal contact with the components to be cooled, and an array of comb or fin like protrusions to increase the surface contact with the air, and thus the rate of heat dissipation. A heat sink is sometimes used in conjunction with a fan to increase the rate of airflow over the heat sink. This maintains a larger temperature gradient by replacing warmed air faster than convection would. Therefore, some helmet systems in accordance with the present disclosure can utilize a fan to increase the rate of heat dissipation, as may be needed in extreme operational conditions, for example.

Therefore, helmet systems in accordance with the present disclosure can be configured to provide their protective properties even when worn in extremely harsh conditions, including extreme cold and extreme heat. As climate change progresses, the world is experiencing an increasing frequency and intensity of extreme weather events, including severe heat waves and bitter cold snaps. Thus, helmets worn by personnel are exposed to such weather events, which can decrease performance of the protective materials. The temperature regulation system of the present disclosure, however, can provide a temperature control system capable of operating across a wide range of temperatures, enabling users to continue working productively even in such extreme conditions. Thus, whether exposed to scorching heat or biting cold, the presently disclosed systems and methods can help to maintain optimal temperatures of a user's helmet through intelligent heating and cooling mechanisms, as described herein.

As is to be appreciated, a wide array of various approaches can be used to supply power to a temperature regulation system of a helmet system. In some embodiments, an integrated battery can be used as a power source for seamless integration into any part of the helmet. This includes batteries in a variety of shapes, such as, but not limited to, square, rectangular, circular, semi-circular, triangular, pentagonal, and so forth, as illustrated below. Battery structures can also have different features such as, but not limited to, stretchable batteries, fiber-shaped batteries, and paper-like batteries. Battery power sources can also vary from low power to high power and from batteries with one cell to batteries with multiple cells. 3D-designed batteries can use the circumference of the helmet to allow for a seamlessly integrated design that does not impede the traditional aerodynamic design of a helmet.

The power source type and placement can be determined by helmet design to ensure proper ergonomics and proper balance from the added battery weight. Thus, batteries or other power sources can be positioned, coupled, or otherwise attached at various locations on, in, or proximate to the helmet such as the side, ear apertures, bottom lips of the helmet, front, rear, back top, brims, straps, suspension systems, liners, independent rotational impact systems, integrated rotational impact systems, as well as other placement locations, as illustrated below. In some instances, multiple power sources can be placed at various locations within a helmet. In some embodiments, the power source is placed internal to the helmet while other embodiments place the power source external to the helmet. For instance, the power source can be coupled to an outer surface of the helmet or otherwise positioned or mounted external and remote from the helmet, but still tethered to the electronics of the helmet system.

Figure 4:
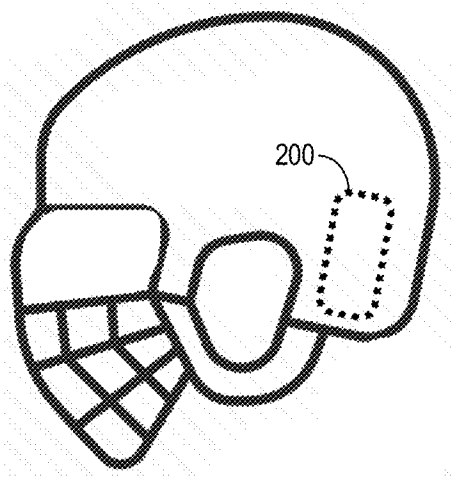
FIGS. 2-4 schematically depict a power source placed on a side of a helmet, in accordance with various non-limiting embodiments.
Figure 3:
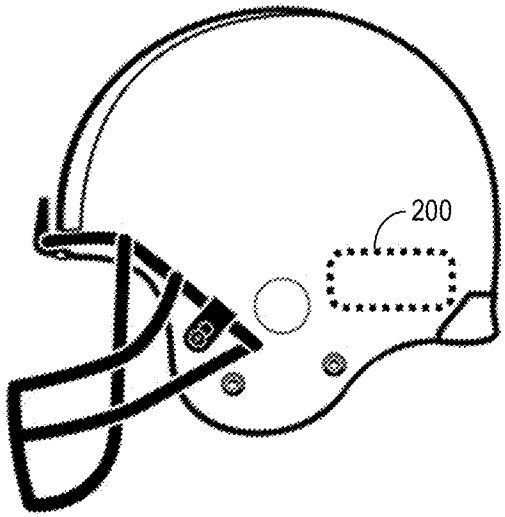
Figure 2:
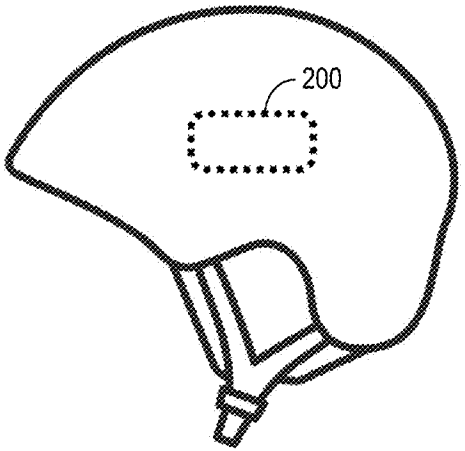
Figure 7:
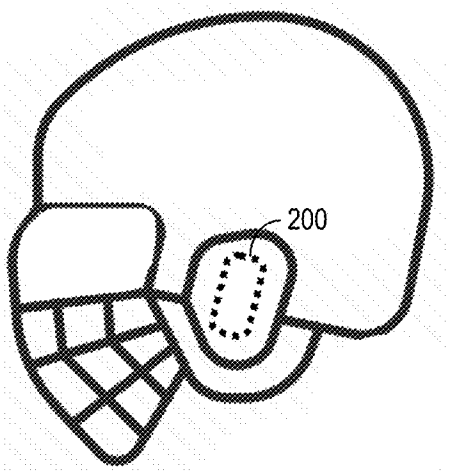
FIGS. 5-7 schematically depict a power source positioned in an opening of a helmet, such as an ear aperture, or other type of opening, in accordance to various non-limiting embodiments.
Figure 6:
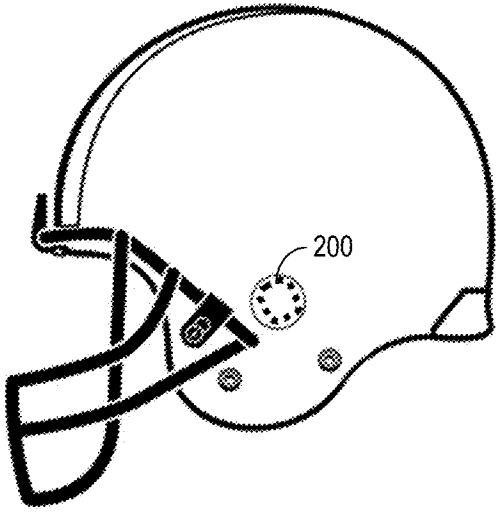
Figure 5:
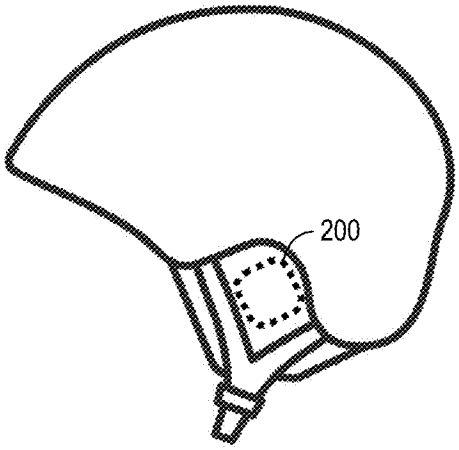
Figure 10:
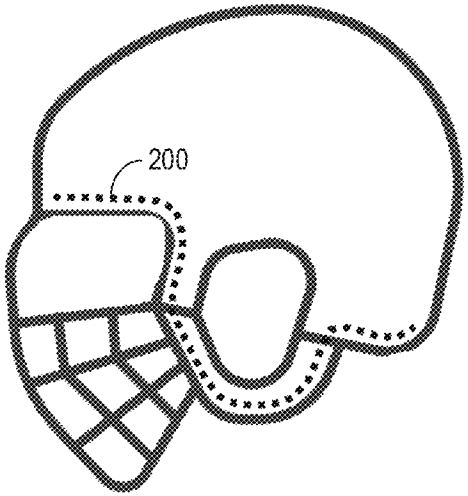
FIGS. 8-10 schematically depict a power source in a snake-like configuration positioned on a bottom lip of a helmet, in accordance with various non-limiting embodiments.
Figure 9:
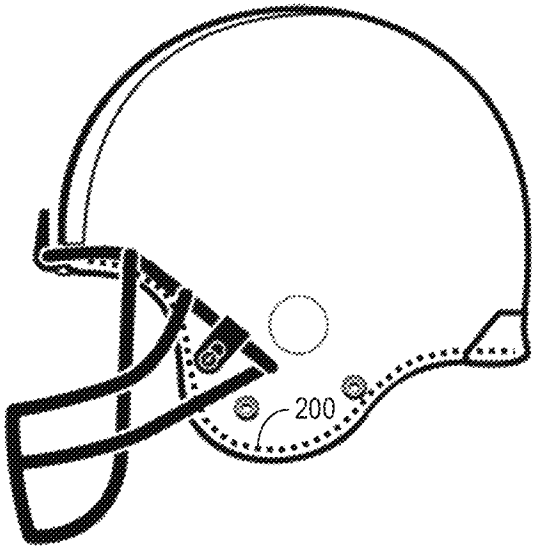
Figure 8:
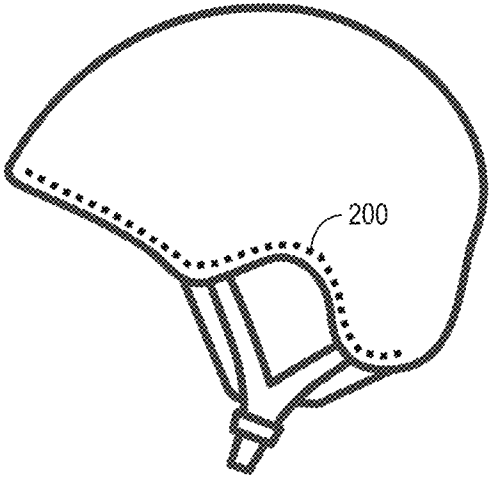
Figure 12:
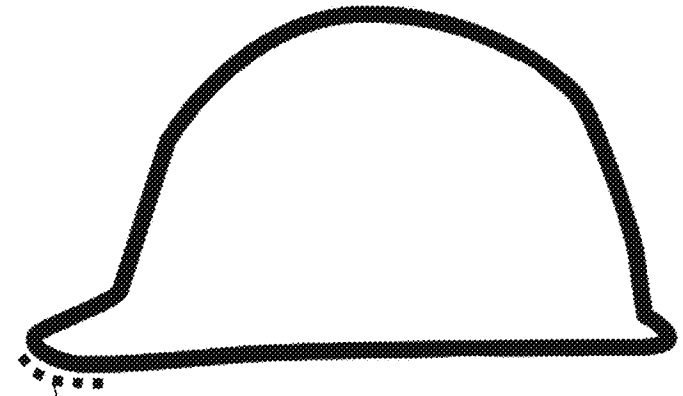
FIGS. 11-12 schematically depict a power source coupled to a brim of a helmet, in accordance with various non-limiting embodiments.
Figure 11:
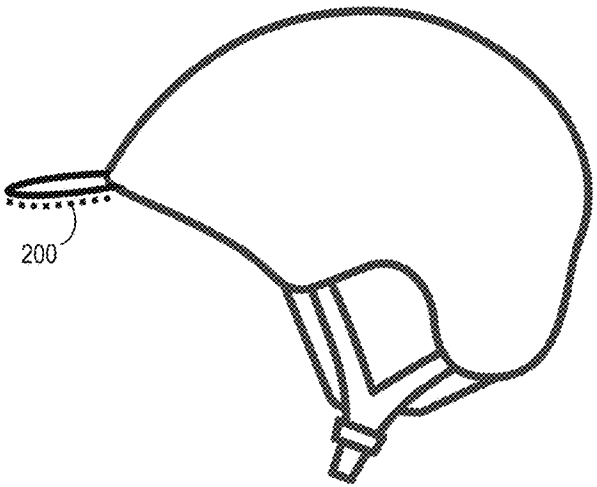
Figure 13:
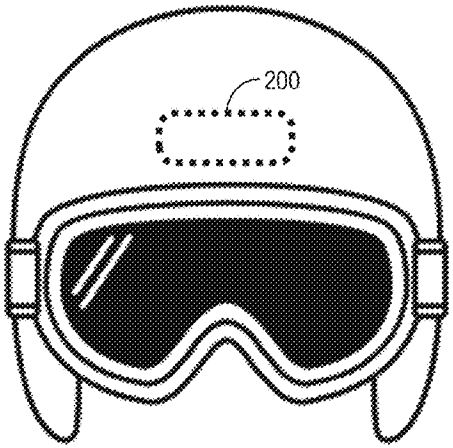
FIG. 13 schematically depicts a power source coupled to the front of a helmet, in accordance with one non-limiting embodiment.
Figure 15:
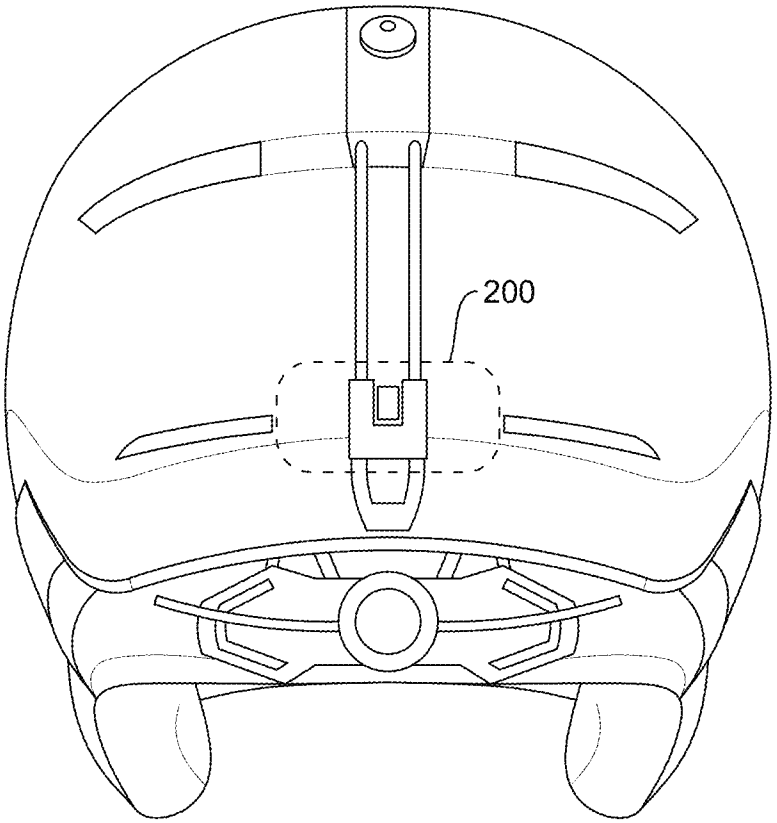
FIG. 15 schematically depicts a power source coupled to a back of a helmet, in accordance with one non-limiting embodiment.
Figure 14:
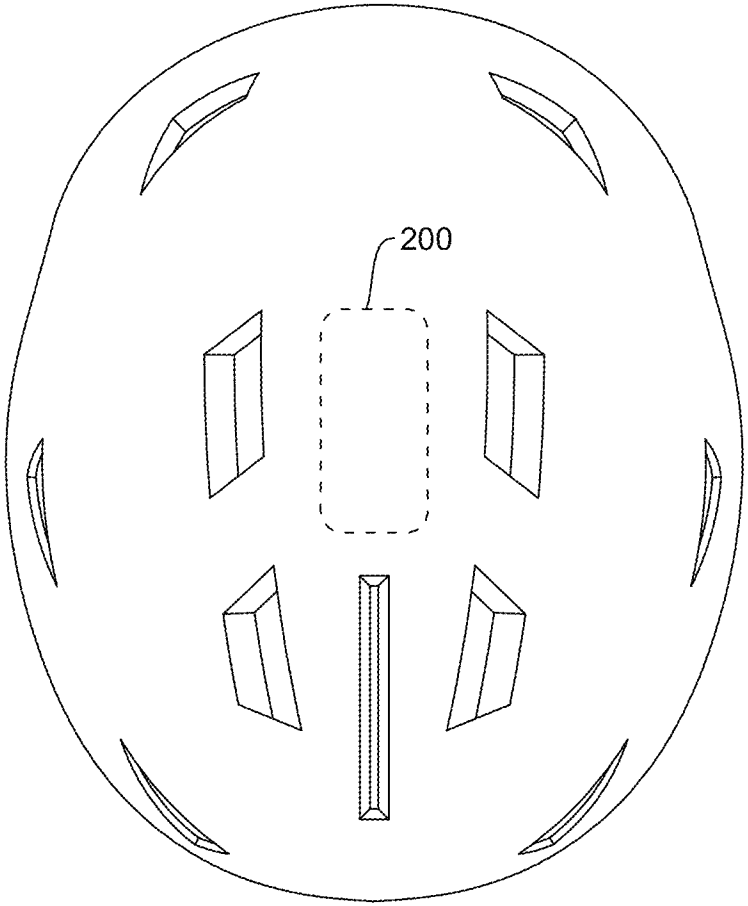
FIG. 14 schematically depicts a power source coupled to a top of a helmet, in accordance with one non-limiting embodiment.
Figure 17:
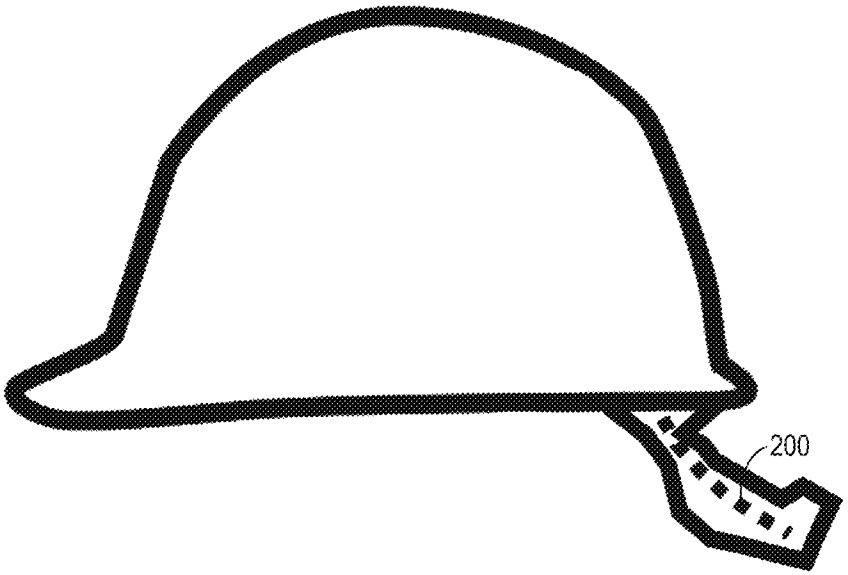
FIG. 17 schematically depicts a power source coupled to a suspension system of a helmet, in accordance with one non-limiting embodiment.
Figure 16:
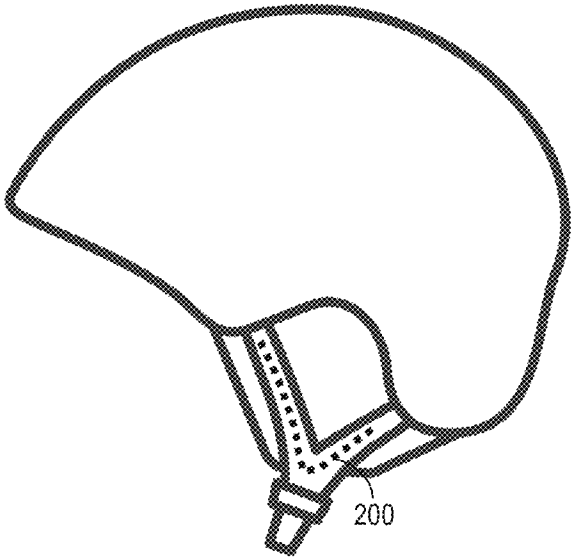
FIG. 16 schematically depicts a power source coupled to a strap of a helmet, such as a chin strap, in accordance with one non-limiting embodiment.
Figure 20:
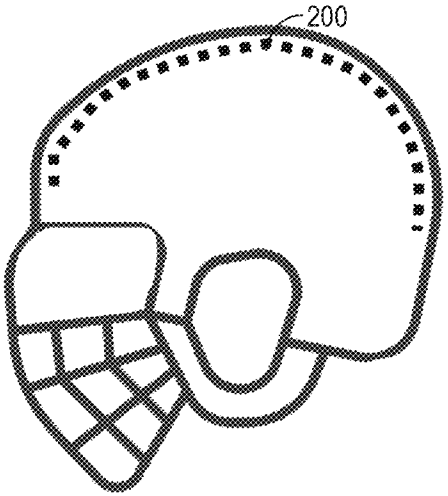
FIGS. 18-20 schematically depict a power source incorporated into, or otherwise placed, within a helmet's liner or rotational protection system, in accordance with one non-limiting embodiment, in accordance with various non-limiting embodiments.
Figure 19:
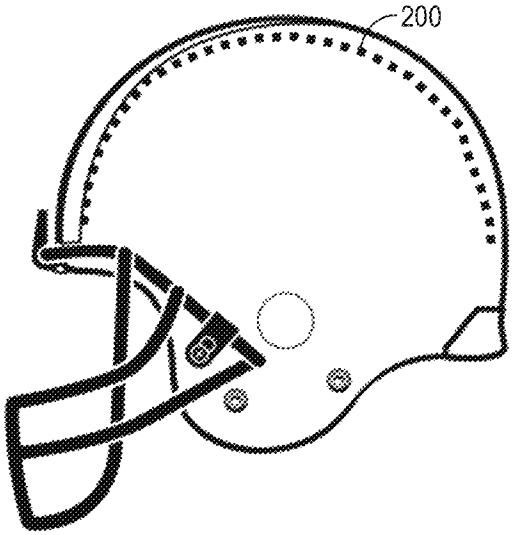
Figure 18:
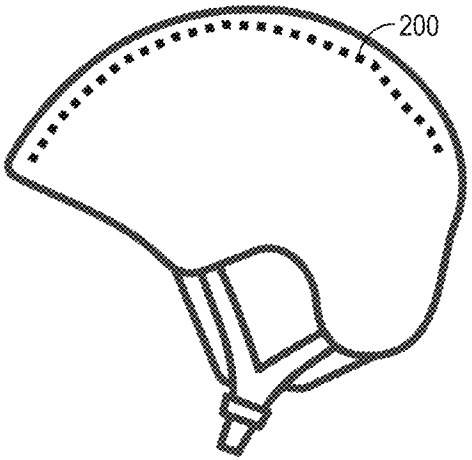
Figure 23:
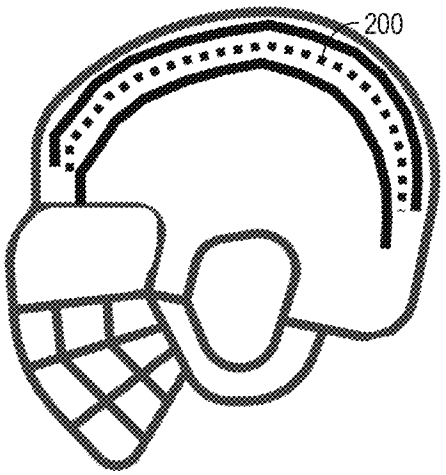
FIGS. 21-23 schematically depict a power source placed between various layers or other protective structures or features of a helmet, in accordance with various non-limiting embodiments.
Figure 22:
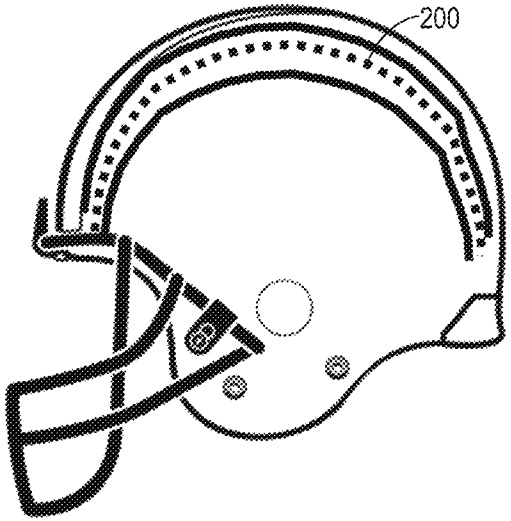
Figure 21:
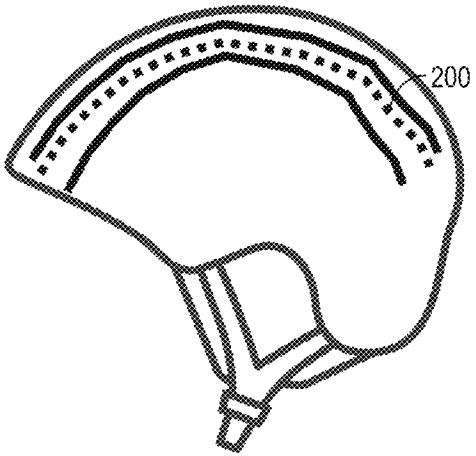

FIGS. 2-23 schematically illustrate the placement of an example power source 200 for various types of helmets. By way of non-limiting examples, FIGS. 2-4 schematically depict the power source 200 placed on a side of the helmet. As with the other embodiments described herein, the power source 200 can be placed either internally or externally to the helmet. FIGS. 5-7 schematically depict the power source 200 positioned in an opening of the helmet, such as an ear aperture, or other type of opening. FIGS. 8-10 schematically depict the power source 200 in a snake-like configuration positioned on a bottom lip of the helmet. FIGS. 11-12 schematically depict the power source 200 coupled to the brim of a helmet. In various embodiments, the power source 200 can be coupled on top of a brim, underneath a brim, or otherwise positioned internal to a brim. FIG. 13 schematically depicts the power source 200 coupled to the front of a helmet. FIG. 14 schematically depicts the power source 200 coupled to the top of a helmet. FIG. 15 schematically depicts the power source 200 coupled to the back of a helmet. FIG. 16 schematically depicts the power source 200 coupled to a strap of the helmet, such as a chin strap. FIG. 17 schematically depicts the power source 200 coupled to the suspension system of a helmet. As schematically shown in FIGS. 18-20, in some embodiments a power source 200 can be incorporated into, or otherwise placed, within a helmet's liner or rotational protection system. FIGS. 21-23 schematically depict embodiments in which a power source 200 is placed between various layers or other protective structures or features of a helmet. While FIGS. 2-23 depict non-limiting power source configurations and placements, it is to be appreciated that a wide variety of other power source configurations and placements are within the scope of the present disclosure.

Figure 26:
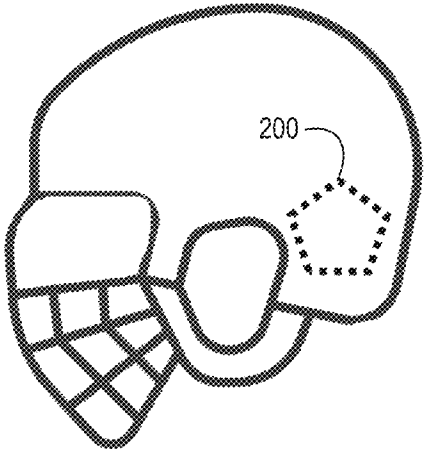
FIGS. 24-26 schematically illustrate various shapes of power sources, in accordance with various non-limiting embodiments.
Figure 25:
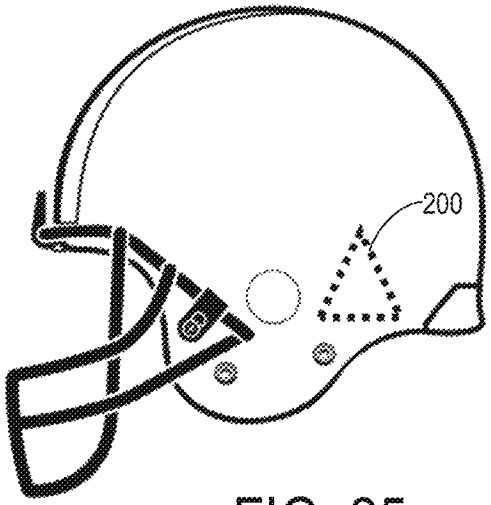
Figure 24:
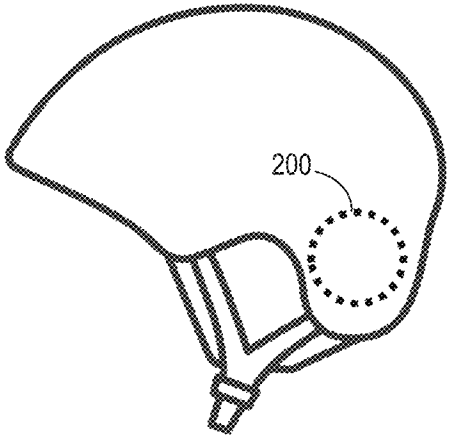

Helmet systems in accordance with the present disclosure can utilize a battery-based power source. In some embodiments, the battery is a Lithium-Ion battery, but this disclosure is not so limited. For example, other suitable batteries or power sources can include, without limitation, Lithium Iron Phosphate (LFP), Lithium cobalt oxide (LCO), Lithium Manganese Oxide (LMO), Lithium nickel manganese cobalt oxide (NMC), Lithium nickel cobalt aluminum oxide (NCA), Lithium titanate (LTO) batteries, sodium-ion batteries, and Interdigital electrodes batteries. Moreover, beyond Lithium-based, other battery types can include nickel metal hydride (NIMH), alkaline, solar, and so forth. In some embodiments, batteries can feature a variety of different technologies, ranging, but not limited to, Liquid Electrolyte batteries such as a Liquid Lithium Ion Battery, Solid State Batteries (SSB), which feature a Solid-State Electrolyte (SSE), such as a Solid-State Lithium Battery, Gel State electrolytes and even Gooey State batteries. In some embodiments, batteries can feature a variety of different electrolytes, ranging, but not limited to, solid-based electrolyte polymers, liquid state-based electrolyte polymers, gooey state-based polymers, solid ceramic electrolytes, liquid organic matter, lithium salts, soluble salts, soluble acids, and other bases in liquid, gelled or dry formats. In some embodiments, these can include non-flammable electrolytes. Flame proofing electrolytes can be integrated such as, but not limited to, Solvent-Anchored non-Flammable Electrolyte (SAFE) can be added to improve battery safety, such as non-flammable electrolyte for lithium-ion batteries with the addition of LiFSI, (a lithium salt that can be added and synthesized) to a polymer-based electrolyte, which contains flammable solvent molecules. SAFE enables Lithium-Ion to operate at temperatures between 77 and 212 degrees F. The ample added salts act as anchors for the solvent molecules, preventing them from evaporating. In some embodiments of the present disclosure, polymer-based electrolytes can feature ranges of salt content that exceed 30%, 40%, 50%, 60%, 70% of overall polymer's weight. SAFE electrolytes enables development of batteries that are both high energy density and safe. In some embodiments the battery is made of aluminum, salt, nickel, and ceramic. The shape, configuration, and size of a power source utilized by helmet systems in accordance with the present disclosure can vary. FIGS. 24-26 schematically illustrate various shapes of power sources 200. As is to be readily apparent, however, other embodiments may utilize power sources having different shapes or arrangements.

To ensure reliable and efficient operation in cold weather conditions, some embodiments of the present disclosure may utilize a battery that specifically operates well in such environments, such as a sodium-ion battery. While lithium-ion batteries are the industry standard for many portable electronic devices, sodium-ion batteries offer unique advantages when operating in low-temperature environments. Unlike lithium-ion batteries, which can suffer from reduced performance and capacity degradation in cold temperatures, sodium-ion batteries maintain their electrochemical properties and deliver consistent power output even in freezing conditions. This characteristic is particularly beneficial for helmet systems intended for use in harsh, cold climates or industrial applications where temperature fluctuations are common. Moreover, sodium-ion batteries can have an extended cycle life, enabling a higher number of charge/discharge cycles before degradation, which translates to a longer operational lifespan for the temperature regulation system.

Furthermore, in accordance with some embodiments, a power source can be tethered to the helmet through flexible conductors, thereby allowing the user to, for example, place or otherwise mount the power source in goggle straps, in a pocket, mount on a belt, hang on a lanyard, or otherwise position within a ski jacket, uniform, body strap, or jersey during use. In some embodiments, heat generated by the power source can be harvested and applied to various components of the associated helmet. Further, the temperature regulation system can include a battery's battery management system (BMS), to provide feedback about a charging process and ensure appropriate power delivery is being used in a sufficient proportion by the battery electrolytes rather than being converted to damaging heat.

In some embodiments, the power source includes a battery that is replaceable or rechargeable. Different types of battery charging systems can include charging cables, wireless charging, magnetic charging, inductive charging, radio charging, near field charging, Qi charging, pulse charging, resonance charging, port charging, dock charging, among other suitable technologies. Moreover, in some embodiments, the helmet can include an output charge port and/or a wireless output charging feature to allow a user to charge a mobile device using the helmet's power source.

Figure 30:
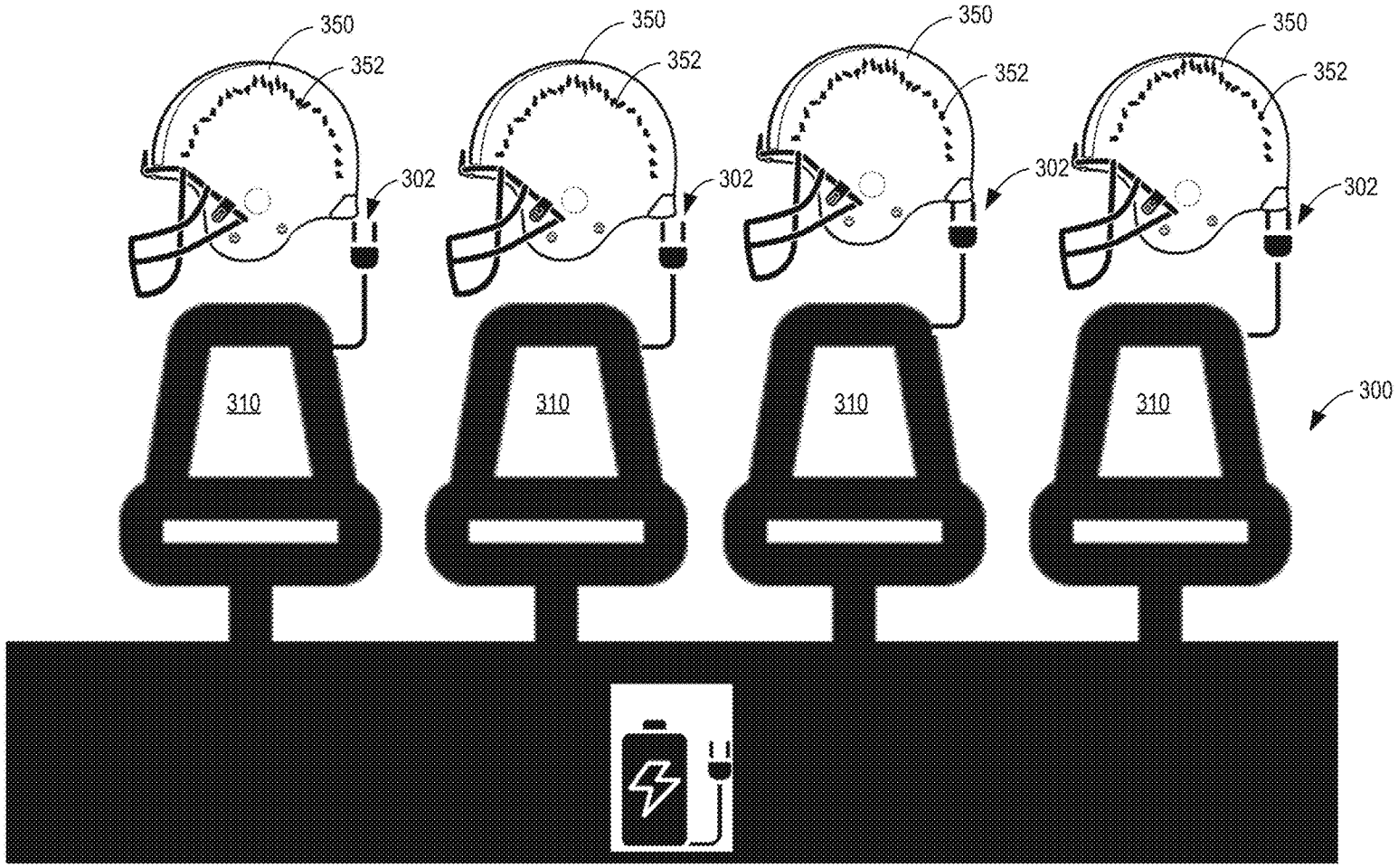
FIG. 30 schematically depicts an example charging system, in accordance with various non-limiting embodiments.

A rechargeable battery can be selectively coupled to a charging station via a dock, charging cable, wireless/inductive connection, or other connection means, for example. Without limitation, this embodiment could be used for rental helmets, professional leagues when players are resting during the games on the sidelines, or a variety of other use cases. FIG. 30, for example, schematically depicts an example charging system 300. In the example embodiment, charging system 300 is a sideline charging system that includes a plurality of seats 310 that are each associated with a charging dock 302. Helmets 350 having a temperature regulation system 352 can be connected to the sideline charging system 300 via the charging docks 302. The charging docks 302 can be a wired dock or a wireless dock, for example.

In some embodiments, a temperature regulation system in accordance with the present disclosure can feature a variety of access points to easily and quickly replace batteries in instances when timing is critical, such as instances of helmet rentals or competitions. The helmet system can provide access to battery replacement via a battery cover structure such as, but not limited to, a battery cover latch, a battery sliding latch, a battery screw on latch, or a battery locking latch. The latching systems can include a variety of applications such as, but not limited to, mechanical and magnetic.

In some embodiments, a temperature regulation system can use any of an external power source, a fixed power source, or portable electrical power source and module that can be charged using a charging cable, including, but not limited to, a standard charging cable, low-voltage cable, romex cable, Non-metallic, or NM cable, NM-B cable, Underground Feeder (UF) cable, USB-A, Micro-USB, USB-C, Lightning, Thunderbolt, Barrel Connector, Magnetic Charging Cable, Charging dock, and charging cases. In some embodiments, the helmet system has receptor ports or points to receive power. Without limitation, this embodiment could be used for professional sports leagues when players are resting during the games on the sidelines, or other suitable use cases. In some embodiments, the temperature regulation system can collect or otherwise capture or harvest ambient energy from cellular/mobile, radio frequency, TV signals and other wireless energy sources to power. In some instances, solar panels can be integrated in the external rigid layer of the helmet to further extend the battery life of the helmet.

Figure 29:
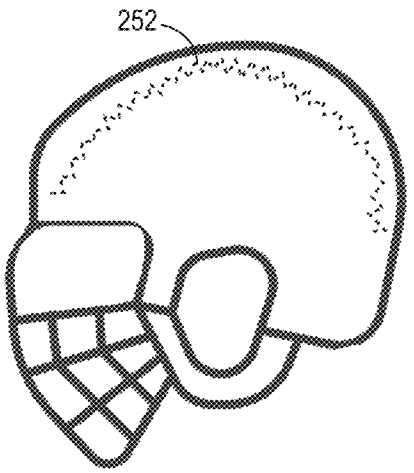
FIGS. 27-29 schematically depict a temperature regulation system positioned internally to a helmet, in accordance with various non-limiting embodiments.
Figure 28:
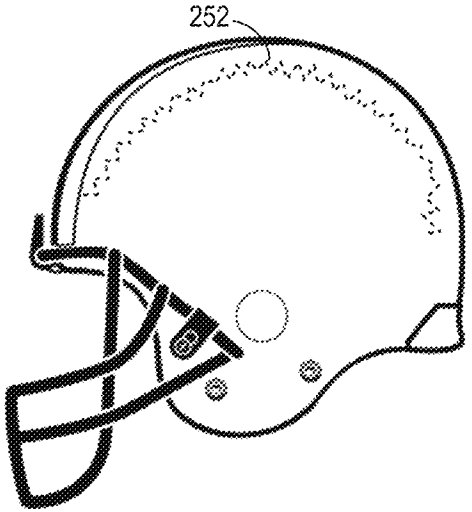
Figure 27:
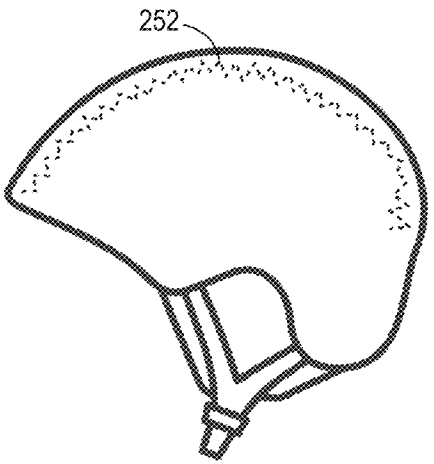
Figure 45:
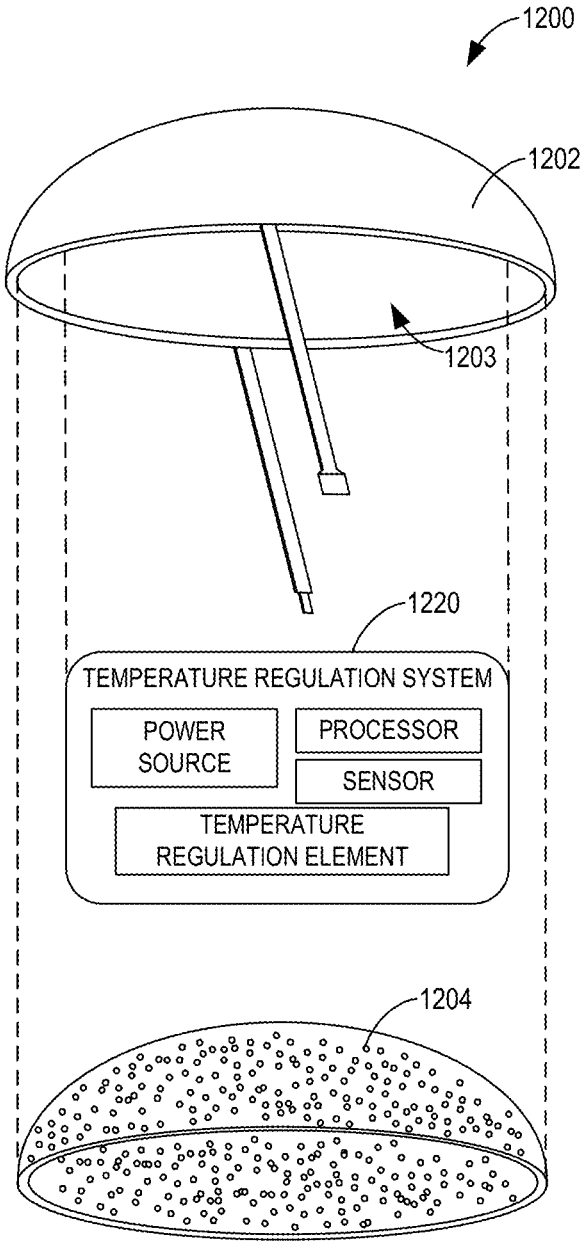
FIG. 45 depicts a simplified exploded view of an example helmet system having a temperature regulation system, in accordance with one non-limiting embodiment.

FIGS. 27-29 schematically illustrate a temperature regulation system 252 positioned internally within a helmet. Some components of the temperature regulation system 252 can be placed, for example, between an outer protective shell and various pliable or semi-rigid protective features that may be positioned inside the outer protective shell. Referring now to FIG. 45, a simplified exploded view of an example helmet system 1100 having a temperature regulation system 1120 is depicted. The helmet system 1100 can include an outer protective shell 1102 and an inner protective system 1104, examples of which are described in more detail below. The outer protective shell 1102 made from various materials, including but not limited to, rigid plastics, semi-rigid polymers, soft elastomers, or combinations thereof. The choice of material can depend on, for example, the specific application and desired level of protection. The helmet system 1100 can also include the temperature regulation system 1120, which is schematically shown in FIG. 45, which can wholly or partially be positioned within a cavity 1103 defined by the outer protective shell 1102, for example. The temperature regulation system 1120 can include a power source, a processor, a sensor, and one or more temperature regulation elements. As provided above, the power source can be placed at any suitable location, including external to the helmet. The sensor can generate an output signal based on a sensed temperature and provide the signal to the processor. Based on a control algorithm, the processor can cause the power source to provide electrical power to the temperature regulation element. While one temperature regulation element is shown in FIG. 45 for illustration purposes, it is to be appreciated that the temperature regulation system 1120 can include a plurality of temperature regulation elements that heat, cool, or can selectably heat or cool.

Figure 33:
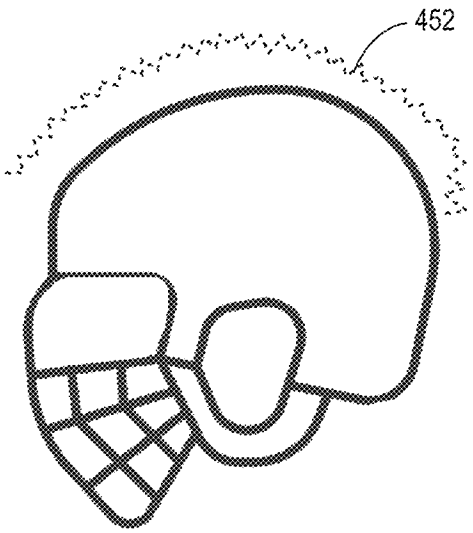
FIGS. 31-33 schematically depict a temperature regulation system that can be positioned on the external surface of a helmet, in accordance with various non-limiting embodiments.
Figure 32:
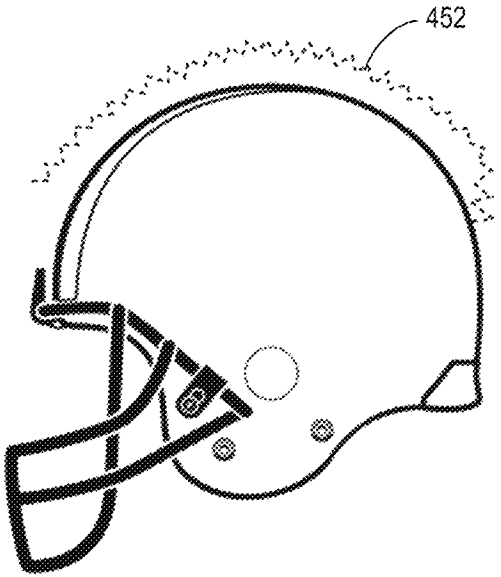
Figure 31:
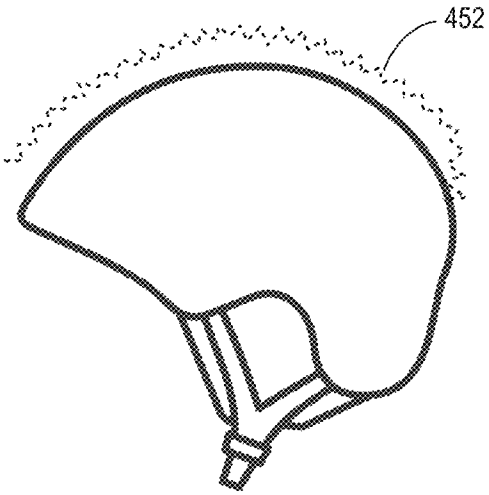

Additionally, or alternatively, temperature regulation systems in accordance with the present disclosure can utilize heating and cooling devices, wraps, covers, enclosures, and/or fans can be temporarily positioned inside or outside of the helmet to quickly facilitate various components reaching optimal protective temperatures. By way of example, FIGS. 31-33 schematically illustrate a temperature regulation system 452 that can be positioned on the external surface of a helmet. As such, the temperature regulation system 452 can be either a heating wrap, a cooling wrap, or combination heating and cooling wrap. Such temperature regulation system 452 can be placed on the helmet in between uses, such as when a player is on the sideline of game, in between rentals of a helmet, when a firefighter is outside a burning structure, or other suitable times when the helmet is not in use. Moreover, temperature regulation systems of other embodiments can include heating and cooling devices, wraps, covers, or enclosures that are intended to be attached to the helmet while the helmet is in use, either temporarily or permanently.

The material or materials of the outer protective shell of a helmet system in accordance with the present disclosure can vary, but in some embodiments the outer protective shell is made from either a rigid material, semi-rigid material, a semi-soft material, soft shell material, or combinations thereof. The protective layers and materials throughout the entire helmet can comprise one or more of the following materials, mixtures or blends of such materials: ABS (Acrylonitrile Butadiene Styrene), ABS Flame Retardant, ABS High Heat, ABS High Impact, PVC (Polyvinyl Chloride), PVC 20% Glass Fiber Reinforced, PVC Plasticized, PVC Rigid, (PVDF) Polyvinylidene Fluoride, ASA (Acrylonitrile Styrene Acrylate), ASA/PVC blend, Cellulose Acetate, PC (Polycarbonate), EPP (Expanded Polypropylene), EPS (Expanded Polystyrene), EVA (Ethylene Vinyl Acetate), Vinyl Nitrate, TPU (Thermoplastic polyurethane), (ECTFE) Ethylene Chlorotrifluoroethylene, (ETFE) Ethylene Tetrafluoroethylene, (FEP) Fluorinated Ethylene Propylene, (PE) Polyethylene, (HDPE) High Density Polyethylene, Polyethylene Glass Fiber, (HIPS) High Impact Polystyrene, HIPS Flame Retardant, Ionomer (Ethylene-Methyl Acrylate Copolymer), (LCP) Liquid Crystal Polymer, LCP Carbon Fiber-reinforced, LCP Glass Fiber-reinforced, LCP Mineral-filled, (LDPE) Low Density Polyethylene, (LLDPE) Linear Low Density Polyethylene, Transparent Acrylonitrile Butadiene Styrene (PA 66) Polyamide 6-6, PA 66 Impact Modified, (PAI), (PI) Polyimide, (PEI) Polyetherimide, (Aramid) Aromatic Polyamide including para-aramids & meta-aramids, Vectran, (PDMS) Polydimethylsiloxane, Polyamide Imide, (PAR) Polyarylate, (PBT) Polybutylene Terephthalate, (PCTFE) Polymonochlorotrifluoroethylene, (PEEK) Polyetheretherketone, PEEK 30% Carbon Fiber-reinforced, PEEK 30% Glass Fiber-reinforced, (PESU) Polyethersulfone, (PET) Polyethylene Terephthalate, (PETG) Polyethylene Terephthalate Glycol, (PFA) Perfluoroalkoxy, (POM) Polyoxymethylene-Acetal, POM-Acetal Impact Modified, POM-Acetal Low Friction, (PP) Polypropylene, PP 10-20% Glass Fiber, PP 10-40% Mineral Filled, PP 10-40% Talc Filled, PP 30-40% Glass Fiber Reinforced, PP Copolymer, PP Homopolymer, PP Impact Modified, (PPE) Polyphenylene Ether, (PS) Polystyrene Crystal, PS High Heat, (PCL) Polycaprolactone, (PEF) Polyethylene Furanoate, (PPT) Polypropylene Terephthalate, (PBAT) Polybutylene Adipate Terephthalate, (PSU) Polysulfone, (PTFE) Polytetrafluoroethylene, (SAN) Styrene Acrylonitrile, (PMA) Polymethyl Acrylate, (PMMA) Polymethyl Methacrylate, (PCL) Polycaprolactone, (PBAT) Polybutylene Adipate Terephthalate, (PBS) Polybutylene Succinate, (PIB) Polyisobutylene, (PBSA) Polybutylene Succinate Adipate, (ABS) Acrylonitrile Butadiene Styrene, (ASA) Acrylonitrile Styrene Acrylate, (PVB) Polyvinyl Butraldehyde, (PEBAX) Polyether Blockamides, polyolefins, polyolefin copolymers, military-grade materials, polyesters, carbon fiber, carbon foams, carbon aerogels, carbon nanosheets, carbon nanofibers, carbon nanotubes, metal ions, graphene, titanium, steel, iron, copper, aluminum, silicon, vanadium, chromium, manganese, cobalt, nickel, zinc, niobium, zirconium, molybdenum, palladium, silver, tin, selenium, tantalum, tungsten, lead, gold, platinum, impact absorbing silicone, D30® impact absorbing material, RHEON protective material, fluids, non-Newtonian fluids, impact gel, wovens, non-wovens, metals, cotton, elastomers, composites, IMPAXX® energy-absorbing foam (available from Dow Automotive), DEFLEXION shock absorbing material (available from Dow Corning), Kevlar, styrofoam, polymers, polymer gels, general shock absorbing elastometers, visco-elastic polymers, PORON® XRD impact protection (available from Rogers Corporation), Sorbothane® (available from Sorbothane Inc.), Neoprene (available from DuPont), impact-dispersing gels, fluids and foam filled pods, crash cloud impact absorbing systems, foams, rubbers, metals, alloys, minerals and so forth. In some embodiments, heating elements can be coupled to various surfaces of the outer protective shell for selective heating thereof. Additionally, or alternatively, in some embodiments, cooling elements can be coupled to various surfaces of the outer protective shell for selective cooling thereof.

One or more protective material layers can be breathable and/or generally porous to provide ventilation. In some embodiments, the helmet system layers, inclusive of the outermost layer, has an automated ventilated system that helps drop the temperature of protective layers on warm days and helps increase the temperature of protective layers on cold days. In some embodiments, the padding layer is a mesh material that aids in the breathability of the associate helmet liner system to provide more rapid cooling or heating. The padding layer can be attached to one or more layers. In some embodiments, the padding layers can be generally disconnected and "floating" between the layers. In some embodiments, the padding layer is attached to an elastic member or other portions of the helmet. In some embodiments, heating elements can be coupled to various surfaces of, or otherwise embedded into, the padding layer for selective heating thereof. Additionally, or alternatively, in some embodiments, cooling elements can be coupled to various surfaces of, or otherwise embedded into, the padding layer for selective cooling thereof. These temperature regulation elements, such as a heating and cooling elements, can utilize ventilation and airflow strategies, such as electroactive polymers (EAPs) to dynamically adjust airflow or active ventilation systems leveraging fans and blowers. Heat transfer strategies can additionally aid in both heating and cooling.

In some embodiments, padding layers in accordance with the present systems and methods can comprise a rate dependent material, such as a rate dependent low-density material. Examples of suitable low-density foams include polyester and polyether polyurethane foams. In some embodiments, such foams have a density ranging from about 5 to about 35 pounds per cubic foot (pcf), more particularly from about 10 to about 30 pcf, and more particularly still from about 15 to about 25 pcf. PORON® and PORON XRD® are available from Rogers Corporation, which are open cell, microcellular polyurethane foams, and is an example of one suitable rate dependent foam. However, in order to provide impact resistance, the padding layer can be any suitable energy absorbing or rate dependent materials. As such, other rate dependent foams, such as high-density foams or other types of materials, can be used without departing from the scope of the present disclosure.

In some embodiments, the layers or structures for the different protective materials and components in the helmet can be molded, injection molded, compression molded, thermoformed, encapsulated, laminated, or feature additive manufacturing architectures such as 3D or 4D printed materials. The geometries and architecture of such 3D and 4D structures would aid in displacing or embedding temperature regulating components and circuitry throughout these structures without compromising space.

Some helmet systems in accordance with the present disclosure can include a helmet liner system having one or more fabric layers, for example. The fabric layers of the helmet liner system can include, for example and without limitation, polyester, nylon, spandex, ELASTENE (available from Dow Chemical), cotton, silver-infused fabrics for cooling, or thermal insulation, a variety of fabrics for warmth such as metallic dots (gold, silver, other) to reflect more body heat (thermal reflection) and similar to that of space blanket technology, delivering instant warmth without compromising breathability, and so forth. Various layers of a liner system, including inner or outer layers, can also be of a mesh or otherwise porous material. In some embodiments, the inner and/or outer layers can be a blend of a variety of materials, such as a spandex/polyester blend. In some embodiments, temperature regulation elements can be coupled to various surfaces of, or otherwise embedded into, the liner system layer for selective heating thereof. Additionally, or alternatively, in some embodiments, temperature regulation elements can be coupled to various surfaces of, or otherwise embedded into, the liner system for selective cooling thereof. In some embodiments, the helmet liner systems can incorporate rotational protection systems, such as, but not limited to, MIPS (Multi-directional Impact System), Fluid Inside, SPIN (Shearing Pad Inside), Turbine Technology, Low Density Layer, Koroyd, Shred, and WaveCel.

The fabric materials covering the liner system and inside of the helmet system can have embedded or topical treatments for moisture wicking, antimicrobial and other features. Some embodiments, for example, can utilize Microban® offered by Microban International, Ltd. for antibacterial protection. In some embodiments, various padding layers comprise antimicrobial agents and one or more other fabric layers of the head guard also treated with antimicrobial agents. Antimicrobial protection for the fabric layers can be in the form of a chemical coating applied to the fabric, for example. Generally, antimicrobial technologies combat odor by fighting bacteria resulting in fresher smell for longer and minimizing the frequency of laundering or washing. Any suitable technique can be used to provide head guards with antimicrobial properties. In one embodiment, for example, AEGIS Microbe Shield® offered by DOW Corning Corp. is utilized. Other examples of antimicrobial agents include SILVADUR® offered by The Dow Chemical Company, Smart Silver offered by NanoHorizons, Inc., and HealthGuard® Premium Protection offered by HealthGuard.

In some embodiments, the helmet system, or at least various components of a helmet system, are configured to provide moisture wicking properties. Generally, moisture wicking translates into sweat management, which works by removing perspiration from the skin in an attempt to cool the wearer. Any suitable moisture wicking can be used. In one embodiment, a topical application of a moisture wicking treatment to a fabric of the helmet system is utilized. The topical treatment is applied to give the helmet system the ability to absorb sweat. The hydrophilic (water-absorbing) finish or treatment generally allows the helmet to absorb residue, while the hydrophobic (water-repellent) fibers of the helmet help it to dry fast, keeping the wearer more comfortable. In one embodiment, the blend of fiber is used to deliver moisture wicking properties by combining a blend of both hydrophobic (such as polyester) with hydrophilic fibers. Thermal fabrics and conductive fabrics can also be used to provide energy management for the system. Certain blends of these fibers allow the hydrophilic fibers to absorb fluid, moving it over a large surface area, while the hydrophobic fibers speed drying time. Additionally, or alternatively, in some embodiments the helmet system materials, components, fabrics, including those from helmet and from sensors, batteries, ports and electrical components can include flame retardants and fire resisting treatments and materials.

In some embodiments, the helmet system can include one or more sensors that provide real-time inputs to a control algorithm. Any of a variety of sensors can be used. In some embodiments, the temperature regulation system comprises one or more thermocouples. Thermocouples are temperature sensors that consist of two dissimilar metal wires joined at one end. They work on the principle of thermoelectric effect, where a voltage is generated due to the temperature difference between the two junctions. Additionally, or alternatively, some embodiments the temperature regulation system comprises one or more Resistance Temperature Detectors (RTDs). RTDs are temperature sensors that work on the principle of resistance change with temperature. They typically consist of a pure metal, such as platinum, nickel, or copper, whose resistance increases as the temperature rises. Additionally, or alternatively, some embodiments the temperature regulation system comprises one or more thermistors. Thermistors are semiconductor-based temperature sensors that exhibit a large change in resistance with a small change in temperature. They are available in two types: Negative Temperature Coefficient (NTC) thermistors, where resistance decreases with increasing temperature, and Positive Temperature Coefficient (PTC) thermistors, where resistance increases with increasing temperature. Additionally, or alternatively, some embodiments the temperature regulation system comprises one or more Integrated Circuit (IC) Temperature Sensors. IC temperature sensors are solid-state devices that incorporate temperature-sensing circuitry within an integrated circuit. These sensors typically use the temperature-dependent characteristics of bipolar transistors or diodes to measure temperature. Additionally, or alternatively, some embodiments the temperature regulation system comprises one or more Infrared (IR) Temperature Sensors. Infrared temperature sensors, also known as non-contact temperature sensors, measure the infrared radiation emitted by an object to determine its temperature. Additionally, or alternatively, some embodiments of the temperature regulation system comprise one or more fiber-optic temperature Sensors. Fiber-optic temperature sensors use the principle of temperature-dependent changes in the optical properties of certain materials. These sensors consist of a fiber-optic cable with a temperature-sensitive element at the tip. They offer advantages such as immunity to electromagnetic interference, high accuracy, and the ability to measure temperature in harsh environments.

The temperature regulation system can include a control system designed to regulate the temperature of one or more materials by activating one or more temperature regulation elements in a controlled manner. At the heart of this control system lies a microprocessor or microcontroller unit (MCU) responsible for executing a specialized control algorithm. A temperature sensor can be strategically placed to accurately measure the temperature of the target material and/or the ambient environment temperature. In some embodiments, the sensor continuously monitors the temperature and transmits the temperature data to the processor through a suitable interface, such as an analog-to-digital converter (ADC) or a digital communication protocol like I2C, SPI, or UART.

The processor can be programmed with a control algorithm that analyzes the received temperature data and compares it against predefined temperature thresholds. These thresholds can be calibrated to trigger specific actions based on the desired temperature range or profile. By way of example, when a temperature threshold is reached, the processor can trigger the activation of a temperature regulation element. This temperature regulation element can be an electric resistive element, a Peltier device, or any other suitable heating mechanism, as described above. In some embodiments, the processor can modulate the power supplied to the heating element to maintain the temperature within a specific range.

The control algorithm can be designed to incorporate various control strategies, such as proportional-integral-derivative (PID) control, fuzzy logic control, or model-predictive control, depending on the specific requirements of the application. These advanced control techniques can enable precise temperature regulation, minimizing overshoots or undershoots, and ensuring optimal performance. Additionally, the control system can incorporate safety features and failsafe mechanisms to prevent overheating or thermal runaway. For instance, the processor can monitor the temperature continuously and automatically deactivate the temperature regulation element if the temperature exceeds a predefined maximum threshold, preventing potential damage or hazardous situations. Furthermore, the control system can be integrated with a user interface, such as a display or a set of indicators on the helmet or other device, to provide real-time temperature information and allow for user input or adjustments to the temperature thresholds or other parameters.

The control algorithm can be developed, for example, from key material performance data and insights from various databases. In some embodiments, control algorithms achieve better performance over time as more data is collected. For example, embedded temperature sensors in the temperature regulation system can generate signals responsive to real-time temperature conditions. Based on the signals, the energy required to effectively maximize the protective performance of the helmet system can be automatically adapted. Beyond temperature data, the control algorithm can leverage a variety of parameters, inputs, or other data such that an overall information diagnostic for an activity is leveraged to optimize the temperature regulation.

In some embodiments, the control algorithm can be developed and optimized using cutting-edge artificial intelligence (AI) and machine learning (ML) techniques, leveraging insights and data from various databases. AI and ML algorithms can be employed to analyze vast amounts of historical temperature data, material properties, environmental conditions, and user preferences, enabling the development of highly sophisticated and adaptive control models. These models can learn and evolve over time, continuously refining the control strategies to deliver optimal temperature regulation performance.

One approach involves training a supervised machine learning model, such as a neural network or a support vector machine, using a labeled dataset consisting of temperature profiles, temperature regulation element activations, and corresponding desired outcomes. This dataset can be sourced from simulations, experimental data, or real-world operational data collected from similar tools or applications. The trained ML model can then be integrated into the control algorithm, enabling it to make intelligent decisions on when to activate or deactivate each temperature regulation element, as well as how to modulate the power supplied to achieve the desired temperature profile. The model can take into account various input parameters, such as the current temperature, rate of temperature change, material properties, environmental conditions, type of user, type of users, and so forth to make accurate predictions and adjustments in real-time.

Additionally, reinforcement learning techniques can be employed where the control algorithm learns through trial-and-error interactions with the system, continuously refining its decision-making process to maximize a predefined reward function such as minimizing temperature deviations or optimizing energy efficiency. Furthermore, the control system can leverage insights from various databases, such as material property databases, environmental condition databases, and user preference databases. These databases can provide valuable information on the thermal characteristics of different materials, the impact of environmental factors on temperature regulation, and user-specific preferences or requirements.

By incorporating this data into the AI/ML models, the control algorithm of the present disclosure can adapt its behavior based on the specific material being processed, the ambient conditions, and user-defined settings or constraints, enabling highly personalized and context-aware temperature regulation. Moreover, the control system can be designed to continuously learn and update its models based on real-time feedback and operational data, enabling it to adapt to changes in the system or environmental conditions over time, ensuring long-term accuracy and performance.

Figure 34:
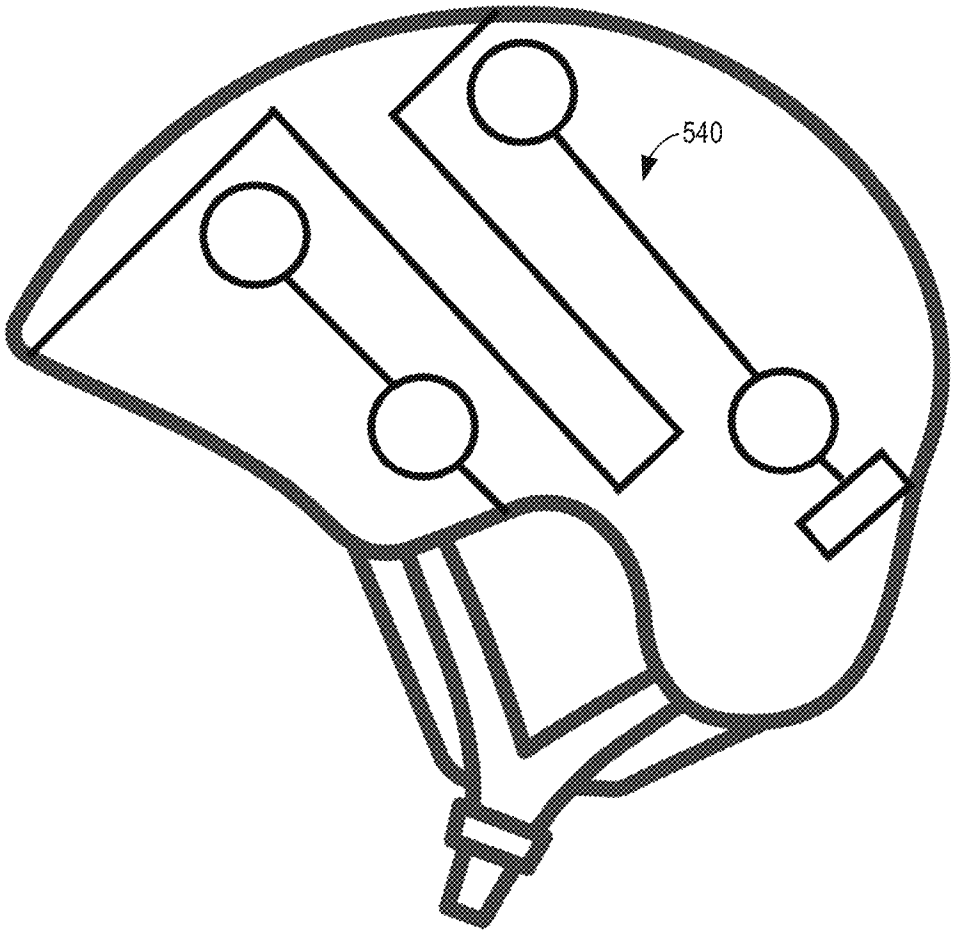
FIG. 34 schematically depicts a helmet system with a sensor network, in accordance with one non-limiting embodiments.

Sensor or sensors of the temperature regulation system can be, for example, embedded in fabrics, miniaturized, encapsulated, or molded into a helmet system component. In some embodiments, sensors can be placed between layers of protective material or layers of fabric to provide additional temperature granularity for the various layers or specific components of the helmet. A specialized and tuned control algorithm can be based on extensive data-collection from the different mechanical properties, material properties, and/or biomechanics testing results of protective materials. Further, the control algorithm can be optimized and applied per helmet product. As such, the control algorithm can be optimized for each use case through modeling through the use of design simulation tools, In some embodiments, the temperature regulation system can also use other sensors and connected technology features (i.e., using Bluetooth) to provide additional insights, communication, and entertainment for the user. Some examples include a pressure sensor or a contact sensor to inform the system when the helmet is being worn so that the energy is preserved when not in use. FIG. 34 schematically illustrates a helmet system with a sensor network 340. The sensor network 540 can include a variety of suitable sensors that can generate real-time signals in response to real-time operational conditions. Accelerometers and gyroscopes can also provide insight into speed and impact data, respectively. GPS sensors can provide location for automated emergency notifications through an integration of the impact sensors and GPS sensors with a connected mobile phone, for example.

As used herein, the term sensor is to broadly include any component or device configured to provide a particular output based on an input. In this regard, example sensors can include, without limitation, accelerometers (for speed, impact), movement sensors, superconducting quantum interference device ("SQUID") sensors, magnetometers (for rotational impact), gyroscope (for angular velocity), temperature sensors (for ambient and/or body temperature), such as, but not limited to, thermometer, thermocouple, thermistor, semiconductor, infrared, fiber optic, silicon diode, resistance temperature detector (RTD), Platinum resistance temperature detector (PRTD), Negative Temperature Coefficient (NTC), long-range wireless temperature sensors. Other sensors that can be incorporated include acoustic sensors, chemical sensors, density sensors, positional sensors, fluid sensors, capacitance sensors, proximity sensors, humidity sensors, vibration sensors, radiation sensors, altimeter, tilt sensors, navigation sensors, GPS sensors, 3D indoor positioning, barometric sensors, optical sensors, image sensors (e.g., video image, static image, brain imaging, etc.). In some embodiments, various sensors of a sensor network 540 can assist with tracking the lifecycle of various components of the helmet system, based on a time of usage, a number of impacts, type of usage, or other operational parameters. When certain parameters are satisfied or thresholds reached, the temperature regulation system or other associated monitoring system can provide an indication that the helmet, or at least a component thereof, has reached the ends of its lifecycle and needs to be replaced or repaired.

Figure 37:
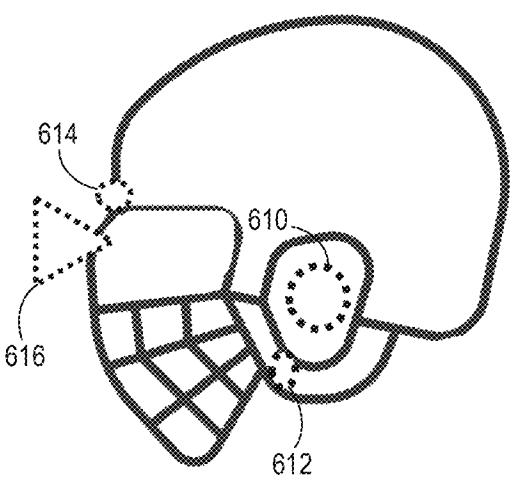
FIGS. 35-37 schematically illustrate helmet systems having various infotainment features, in accordance with various non-limiting embodiments.
Figure 36:
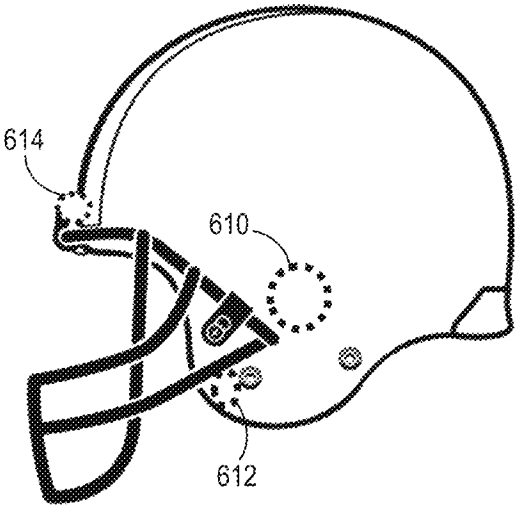
Figure 35:
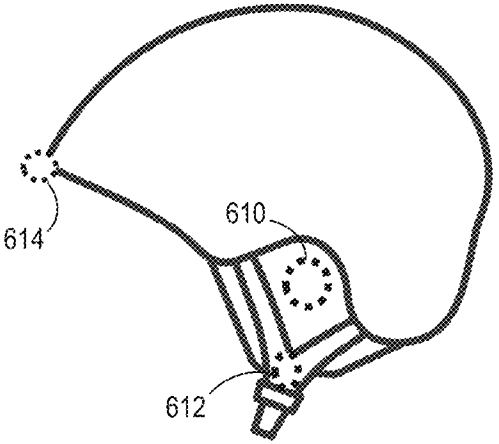

From a biometric standpoint, the helmet system can also contain a variety of sensors such as, but not limited to, heart rate, respiratory rate, heart rate variability, heart rate reserve, ECG or electrocardiogram, EEG or electroencephalogram, skin temperature, blood oxygen saturation, focus, concentration, balance. From a communication standpoint, various helmet systems can connect to Smartphone via Bluetooth, wi-fi and other means. From an entertainment perspective, the helmet can comprise speakers for user to pair a mobile phone or other networked communication device and receive real-time warnings (i.e. avalanche warnings due to seismic activity) or a small camera to record or video stream the user's activities with placement in the front part of the helmet. FIGS. 35-37 schematically illustrate helmet systems having various infotainment features, such as a speaker 610, a microphone 612, a camera 614, and a virtual/augmented reality system 616. Other technology features for the helmet system can include interface with smart goggles which a heads-up display that can feature augmented reality for gaming or to track others, mixed reality (virtual, mixed, and augmented), and can also use artificial intelligence spatial technology. From a battery or power standpoint, a battery sensor can enable the user to obtain the status of the battery or power system. Some battery sensors can feature, but are not limited to, voltage sensor, electronic battery sensor, battery temperature sensor.

Helmet systems in accordance with the present disclosure can include various types of electronic components such as flexible circuits, printed circuit boards (PCBs), fuses, wires, connectors, embedded channels and conduits, sensors, actuators, batteries, mounting points, charging ports, charging pad, wireless charging components, docking ports, buttons, and switches. Additional electronics for entertainment and communications can include cameras, speakers, microphones, augmented or mixed reality goggles.

Figure 41:
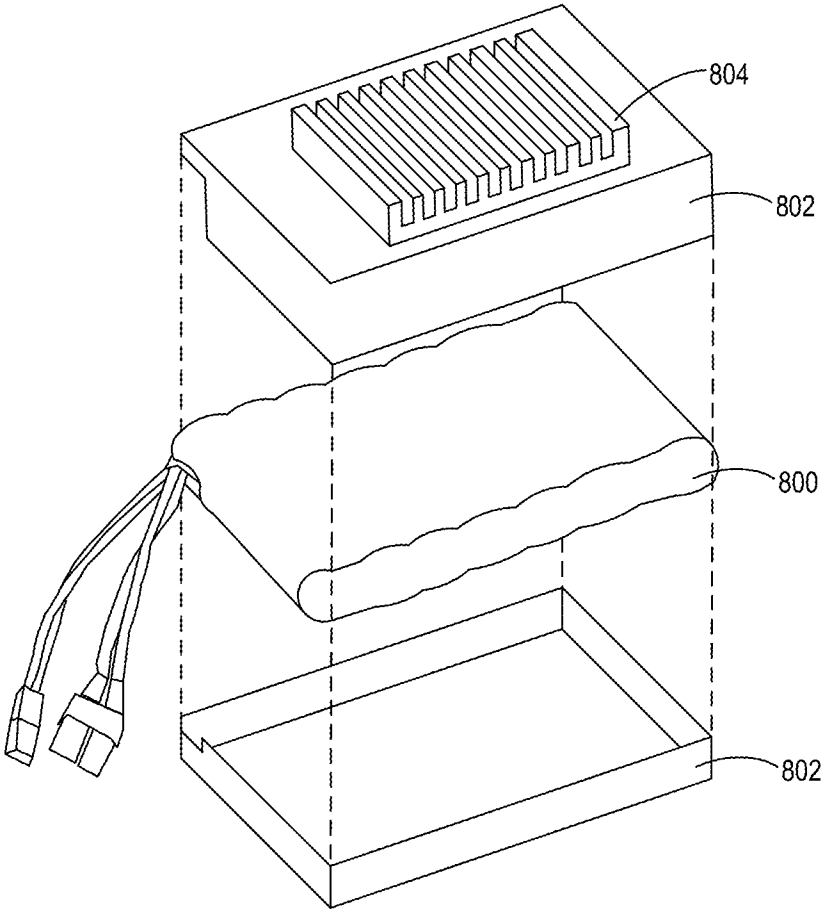
FIG. 41 schematically illustrates an example battery and enclosure system of a temperature regulation system, in accordance with a non-limiting embodiment.

Helmet systems in accordance with the present disclosure can include various types of safety features to protect the electronics, sensors, and battery systems. FIG. 41, for example, schematically illustrates a battery 800 of a temperature regulation system. An enclosure system 802 can be configured to protect the battery 800 from impact or other environmental conditions. A heat sink 804 is shown in FIG. 31 as an additional feature that can be utilized for heat management. The approach for integrating a battery or other power source into a helmet system can depend on the anticipated environmental conditions for the operational activity and the impact frequency or exposure. Such considerations can evaluate, for example, whether Solid State Batteries might provide a safer profile in extreme heat temperatures, given that liquids in Liquid Electrolyte Batteries may have limitations on the temperature range. Such considerations, for example, might include the addition of a Solvent-Anchored non-Flammable Electrolyte (SAFE) that can be added to lithium-ion batteries with the addition of LiFSI, (a lithium salt that can be added and synthesized) to a polymer-based electrolyte, which contains flammable solvent molecules all of which are within the scope of the present disclosure. SAFE enables Lithium-Ion to operate safely at temperatures between 77 and 212 degrees F. Further considerations include whether the enclosures and Casings are made from ABS, PC, aluminum, or any other material to further protect any electrical (battery, sensor, circuit, PCB, etc.) component of the helmet system, all of which are within the scope of the present disclosure. Additional considerations are whether to use fire-retardant materials through coatings such as intumescent paints, silicone-based coatings, encapsulation, molding or any other materials, chemistries, or technologies, all of which are within the scope of the present disclosure. Some embodiments, for example, may include a lithium-ion battery using a nonflammable electrolyte. Some embodiments may use heat shields or insulation materials placed around heat-generating components to prevent excessive heat transfer in surrounding areas to protect adjacent components and ensures safe operation within temperature limits. Some embodiments may utilize overcurrent protection to prevent excessive current flow through electronic components, reducing risk of overheating and fire. Some embodiments may include thermal management systems, such as, but not limited to, heatsinks, fans, liquid cooling systems to dissipate heat generated by electronic components, preventing them from reaching dangerous temperatures. Some embodiments utilize sealing and gasketing to seal electronic components with gaskets or O-rings to help prevent moisture or other contaminants from entering electronic components thereby enhancing reliability and safety. Other embodiments provide shielding against Electromagnetic Interference (EMI). Examples of shielding materials include, but are not limited to, conductive foils and metal enclosures to protect electronic components from external electromagnetic interference, which could potentially cause malfunctions or safety hazards. Some embodiments can include impact protection systems to further protect various electrical components, such as battery, sensor, circuit, PCB, etc., of the helmet system with a protective material or protective system.

Some helmet systems described herein are designed using a safety design modeling system to ensures the components of the helmet system will work in harmony for the specific helmet design—such as to ensure that the there is enough room between the heat-sealed protective pouch around the battery and its internal electronic components (otherwise it could weaken the separator between the electrodes and cause short circuiting). Additional modeling can ensure the right amount of insulation tape for cells, or the right thickness for battery separators. In this regard, a proprietary database with Large Language Models and Generative Artificial Intelligence can screen designs for safety.

Embodiments of the present disclosure can seek to provide heat management and heat dissipation, or otherwise include heat transfer considerations. Some embodiments provide an extreme temperature functionality system such that the electronics, batteries, sensors, and entire helmet system is tested in extreme temperatures to ensure the proper functioning of these systems as failing to do so could result in failure of batteries, inability to charge or other electronic component failures. In cases of extreme low environmental temperatures, it may be necessary to heat the electronic components to achieve satisfactory operation. Different methods and technologies such as, but not limited to, insulation of components could enable proper operation in extreme temperatures. For example, some embodiments can include a Solvent-Anchored non-Flammable Electrolyte (SAFE) that can be added to lithium-ion batteries with the addition of LiFSI, (a lithium salt that can be added and synthesized) to a polymer-based electrolyte; which contains flammable solvent molecules. SAFE enables Lithium-Ion to operate safely at temperatures between 77 and 212 degrees F., versus commercial options that fail at 140 degrees F. Additionally, some embodiments can utilize a multi-integrated sensor system to provide added safety and safeguard all of the materials in the helmet and ensure that the heat transfer, heat mitigation and overall heat management is well studied with sufficient data points to further provide key information so that the algorithm provides the right adjustments to inform the right materials, electrical components, batteries, heating or cooling systems, and configurations for each helmet design.

Figure 38:
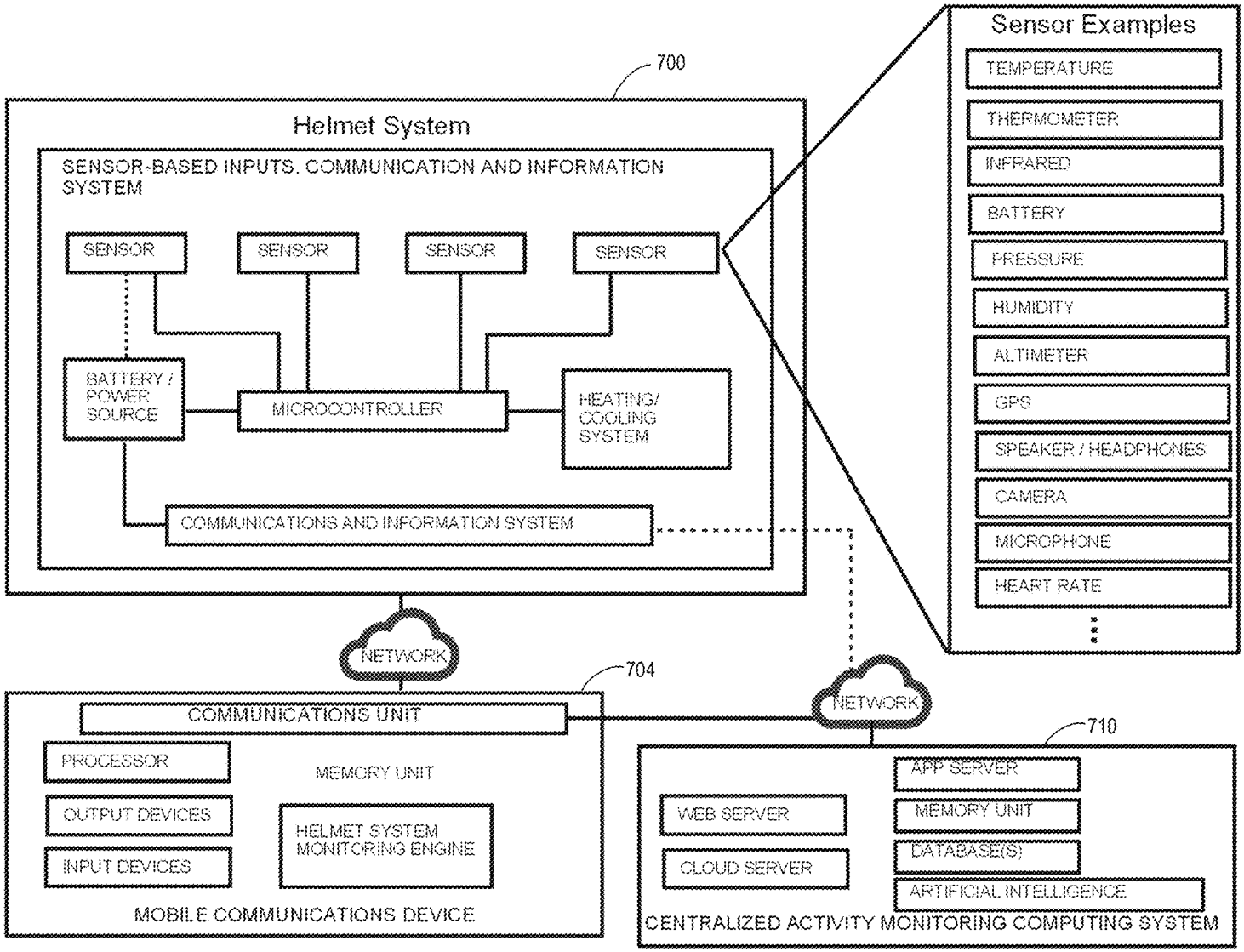
FIGS. 38-40 schematically depict communication capabilities of example helmet systems, in accordance with various non-limiting embodiments.
Figure 39:
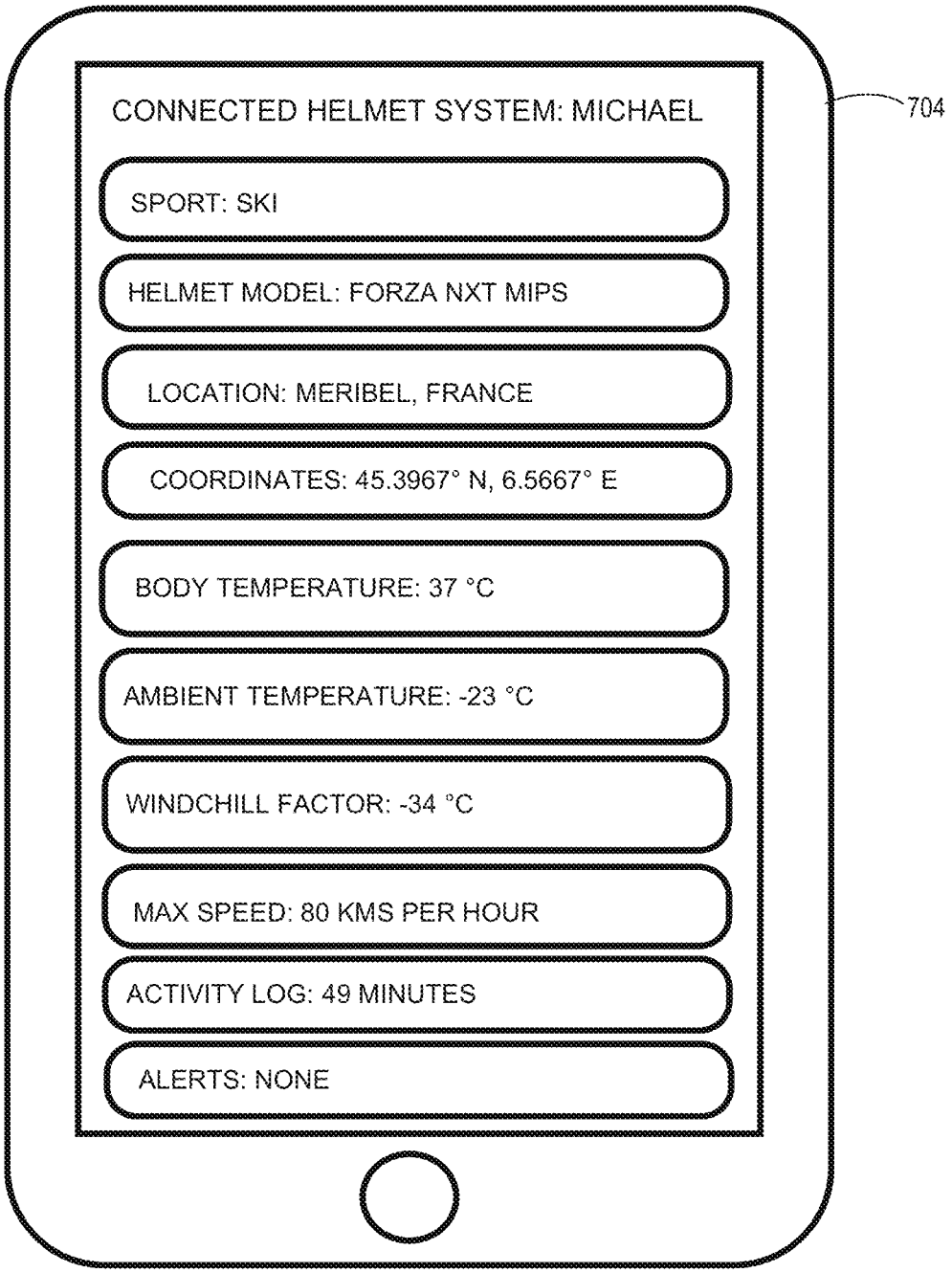
Figure 40:
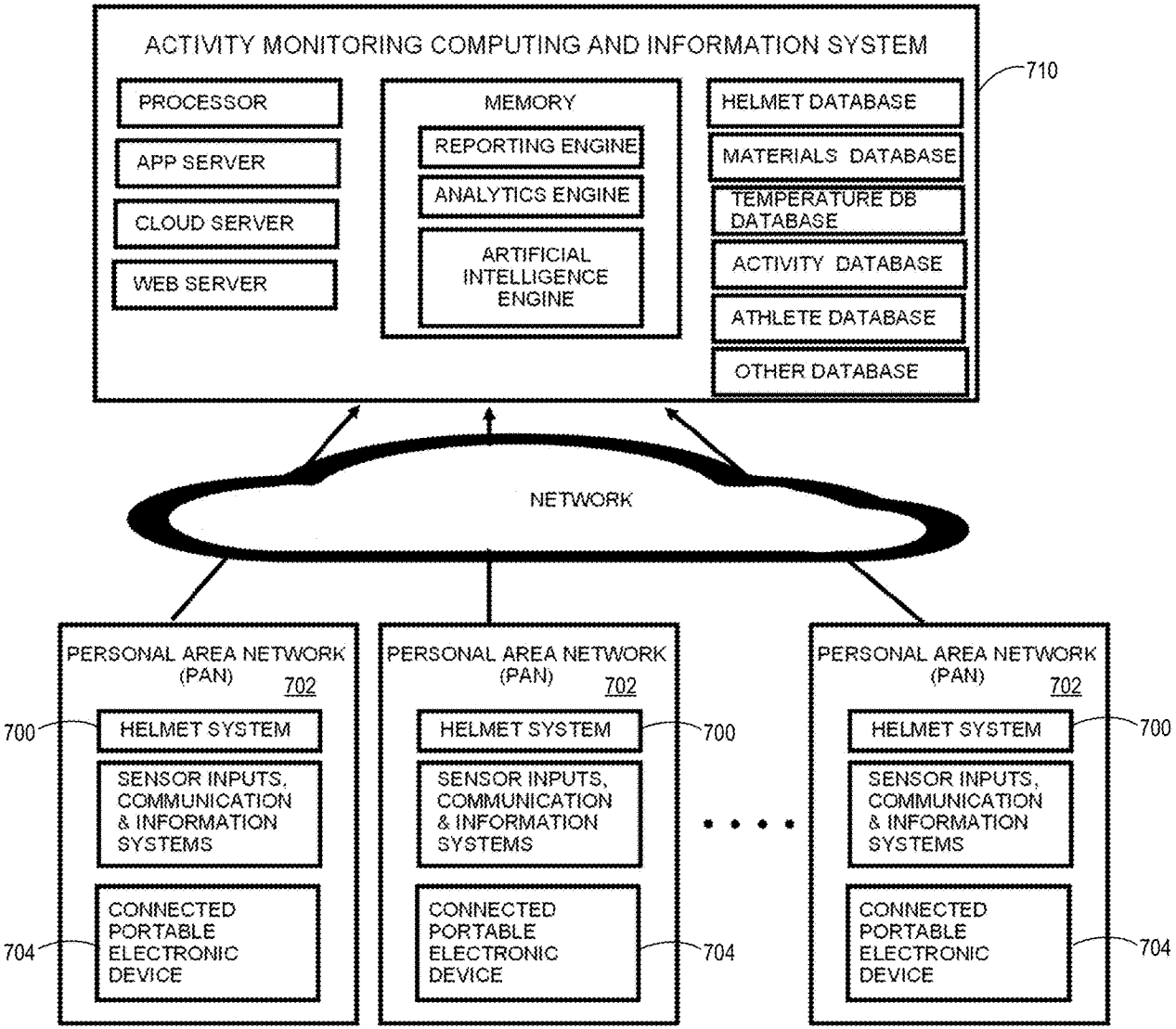

In accordance with various embodiments, helmet systems can include various types of communication capabilities, such as wireless communication abilities, as are schematically illustrated in FIGS. 38-40. In some embodiments, referring to FIGS. 38-40, a helmet system 700 can communicate on a personal area network (PAN) 702 such as using a Bluetooth protocol, or other suitable near field communication (NFC) protocols, to a linked electronic device 704. Using this communication functionally, the helmet system 700 can provide information gathered by one or more of the sensors to a linked electronic device 704. Such information can be provided in real-time, substantially real-time, in batch format, or other suitable periods or timetables. Various types of electronic devices can be linked, such as mobile phones, tablets, laptop computers, desktop computers, wearables, and the like. In some embodiments, as described in more detail below, the linked, paired or connected electronic device can execute a specialized application that is configured to collect data and provide to a user various visualizations, alerts, information, data, and/or other analytics based on data received from an associated helmet. In some embodiments, one or more of the linked, paired or connected electronic devices can also be in communication with a centralized activity monitoring computing system 710 (such as a cloud-based service) that can collect and aggregate data from a plurality of helmet system, including the temperature profile of various components thereof.

The activity monitoring computing system 710 can be in communication with a plurality of mobile communication and wearable devices via the communications network. The network can be an electronic communications network and can include, but is not limited to, the Internet, LANs, WANs, GPRS networks, cloud networks, other networks, or combinations thereof. The network can include wired, wireless, fiber optic, other connections, or combinations thereof. In general, the communications network can be any combination of connections and protocols that will support communications between the activity monitoring computing system, mobile communication device and other wearable devices.

The device can also feature an amplified signal feature (antenna types or signal amplifiers) to enable communication at all times given that in some instances, such as remote areas, ice rinks, and football domes, cell phone signals are limited or interfered with. In some embodiments, the helmet can provide alerts to the wearer when the battery is at 15% so that the user can have enough time to recharge or replace the battery, or take other action.

Referring now to example manufacturing, helmet systems in accordance with the present disclosure can be manufactured through a series of steps that integrate the various components and systems. In some embodiments, the temperature regulation system is installed into a pre-manufactured helmet as an add-on system, such as an "after market" system. In other embodiments, the temperature regulation system is installed during the manufacturing process for the element, such that the temperature regulation system is directly integrated during the manufacturing process.

In various embodiments of the present disclosure, a single component may be replaced by multiple components, and multiple components may be replaced by a single component, to perform a given function or functions. Except where such substitution would not be operative to practice embodiments of the present disclosure, such substitution is within the scope of the present disclosure. Any of the servers described herein, for example, may be replaced by a "server farm" or other grouping of networked servers (e.g., a group of server blades) that are located and configured for cooperative functions. It can be appreciated that a server farm may serve to distribute workload between/among individual components of the farm and may expedite computing processes by harnessing the collective and cooperative power of multiple servers. Such server farms may employ load-balancing software that accomplishes tasks such as, for example, tracking demand for processing power from different machines, prioritizing and scheduling tasks based on network demand, and/or providing backup contingency in the event of component failure or reduction in operability.

The examples presented herein are intended to illustrate potential and specific implementations. It can be appreciated that the examples are intended primarily for purposes of illustration for those skilled in the art. No particular aspect or aspects of the examples are necessarily intended to limit the scope of the present disclosure. For example, no particular aspect or aspects of the examples of system architectures, table layouts, or report formats described herein are necessarily intended to limit the scope of the disclosure.

In general, it will be apparent to one of ordinary skill in the art that various embodiments described herein, or components or parts thereof, may be implemented in many different embodiments of software, firmware, and/or hardware, or modules thereof. The software code or specialized control hardware used to implement some of the present embodiments is not limiting of the present disclosure. Such software may be stored on any type of suitable computer-readable medium or media such as, for example, a magnetic or optical storage medium. Thus, the operation and behavior of the embodiments are described without specific reference to the actual software code or specialized hardware components. The absence of such specific references is feasible because it is clearly understood that artisans of ordinary skill would be able to design software and control hardware to implement the embodiments of the present disclosure based on the description herein with only a reasonable effort and without undue experimentation.

The systems, apparatuses, devices, and methods can include one or more processors and one or more memory units, and in particular can be facilitated through use of any suitable processor-based device or system, such as a personal computer, laptop, server, mainframe, mobile computer, other processor-based device, or a collection (e.g. network) of multiple computers, for example. The processor can execute software instructions stored on the memory unit(s). The processor can be implemented as an integrated circuit (IC) having one or multiple cores. The memory unit(s) can include volatile and/or non-volatile memory units. Volatile memory units can include random access memory (RAM), for example. Non-volatile memory units can include read-only memory (ROM), as well as mechanical non-volatile memory systems such as a hard disk drive, optical disk drive, or other non-volatile memory. The RAM and/or ROM memory units can be implemented as discrete memory ICs. The memory unit can store executable software and data. When the processor executes the software instructions of various modules, the processor can be caused to perform the various operations of the systems, apparatuses, devices, and methods, such as described herein.

The systems, apparatuses, devices, and methods can store and access data in a variety of databases. The data stored in the databases can be stored in a non-volatile computer memory, such as a hard disk drive, read-only memory (e.g. a ROM IC), or other types of non-volatile memory. In some embodiments, one or more databases of the databases can be stored on a remote electronic computer system and can be accessed via a network. As will be appreciated, a variety of other databases or other types of memory storage structures can be utilized or otherwise associated with the systems, apparatuses, devices, and methods.

The systems, apparatuses, devices, and methods can include one or more computer servers, which can include one or more web servers, one or more application servers, and/or other types of servers. The servers can cause content to be sent between or among monitored equipment, one or more dedicated communication hubs, smartphones, and/or remote computing devices, via a network in any of a number of formats. The servers can be comprised of processors (e.g. CPUs), memory units (e.g. RAM, ROM), non-volatile storage systems (e.g. hard disk drive systems), and other elements. The servers can use one or more operating systems including, but not limited to, Solaris, Linux, Windows Server, or other server operating systems.

In some embodiments, a web server can provide a graphical web user interface through which, for example, various users can visualize data captured by the monitored equipment. The graphical web user interface can also be referred to as a graphical user interface, user portal, user interface, graphical client interface, and so forth. The web server can accept requests, such as HTTP requests, from clients and serve the client's responses, such as HTTP responses, along with optional data content, such as web pages (e.g. HTML documents) and linked objects (such as images, video, documents, data, and so forth). The application server can provide a user interface for users who do not use a web browser to view data captured by the monitored equipment. Such users can have special software installed on their computing device to allow the user to communicate with the application server via a network.

In various embodiments, the systems, apparatuses, devices, and methods described herein may be configured and/or programmed to include one or more of the above-described electronic, computer-based elements and components. In addition, these elements and components may be particularly configured to execute the various rules, algorithms, programs, processes, and method steps described herein.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended that the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

The invention claimed is:

1. A helmet system, comprising:

an outer protective shell defining an inner cavity;

an inner protective system positioned within the inner cavity, wherein the inner protective system comprises a padding layer coupled to the outer protective shell;

a temperature regulation system, wherein the temperature regulation system comprises:

at least one temperature regulation element;

a power source configured to provide electrical power to the at least one temperature regulation element;

a sensor configured to generate an output signal based on a sensed temperature; and a processor in communication with the sensor, wherein the processor is configured to provide electrical power to the at least one temperature regulation element responsive to the output signal exceeding a temperature threshold, wherein the temperature threshold is based on a ductile/brittle transition temperature of at least one material of the outer protective shell or the inner protective system, and wherein the temperature regulation system is configured to maintain the at least one material within a temperature range that preserves impact protection performance of the materials across varying environmental conditions.

2. The helmet system of claim 1, wherein the at least one temperature regulation element is coupled directly to the outer protective shell.

3. The helmet system of claim 2, wherein the at least one temperature regulation element applies heat to at least a portion of the outer protective shell when provided with electrical power.

4. The helmet system of claim 2, wherein the at least one temperature regulation element cools at least a portion of the outer protective shell when provided with electrical power.

5. The helmet system of claim 1, wherein the at least one temperature regulation element is coupled directly to the inner protective system.

6. The helmet system of claim 5, wherein the at least one temperature regulation element applies heat to at least a portion of the inner protective system when provided with electrical power.

7. The helmet system of claim 5, wherein the at least one temperature regulation element cools at least a portion of the inner protective system when provided with electrical power.

8. The helmet system of claim 1, wherein the at least one temperature regulation element comprises a first temperature regulation element and a second temperature regulation element.

9. The helmet system of claim 8, wherein the processor is configured to use the first temperature regulation element to produce heat based on a first temperature profile and the processor is configured to use the second temperature regulation element to produce heat based on a second temperature profile.

10. The helmet system of claim 1, wherein the at least one temperature regulation element comprises a thermoelectric cooling module.

11. The helmet system of claim 1, wherein the at least one temperature regulation element comprises a thermal conductive sheet.

12. The helmet system of claim 1, wherein the at least one temperature regulation element comprises a heating means.

13. The helmet system of claim 1, wherein the at least one temperature regulation element can either selectably cool a portion of the helmet system or selectably heat a portion of the helmet system.

14. The helmet system of claim 1, wherein the at least one temperature regulation element comprises a first temperature regulation element and a second temperature regulation element, wherein the first temperature regulation element can selectably cool a portion of the helmet system and the second temperature regulation element can selectably heat a portion of the helmet system.

15. The helmet system of claim 1, wherein the power source is a rechargeable battery.

16. The helmet system of claim 1, wherein the power source is a tethered battery.

17. The helmet system of claim 1, wherein the temperature regulation system comprises one or more of a Peltier module, a phase change material (PCM), a thermal insulation material, a thermal conductive sheet, a conductive material, a carbon fiber filament sheet, and an electrical sheet.

18. The helmet system of claim 1, wherein the outer protective shell comprises a heat absorbing coating.

19. The helmet system of claim 1, wherein the processor is configured to provide electrical power to the least one temperature regulation element based on a control algorithm, wherein the control algorithm is configured to maintain materials of the helmet system within temperature ranges that preserve protective performance of the materials.

20. The helmet system of claim 19, wherein the control algorithm is based on materials performance data related to impact absorption characteristics of the materials at different temperatures.

21. The helmet system of claim 20, wherein the control algorithm is a machine learning-based control algorithm.

22. A helmet system, comprising:

an outer protective shell defining an inner cavity;

an inner protective system positioned within the inner cavity, wherein the inner protective system comprises a padding layer coupled to the outer protective shell;

a temperature regulation system, wherein the temperature regulation system comprises:

a first temperature regulation element configured to deliver heat at least to the outer protective shell;

a second temperature regulation element configured to deliver heat at least to the inner protective system;

a power source configured to provide electrical power to the first temperature regulation element and the second temperature regulation element;

at least one sensor configured to generate an output signal based on a sensed temperature; and a processor in communication with the at least one sensor, wherein the processor is configured to selectably provide electrical power to the first temperature regulation element and selectably provide electrical power to the second temperature regulation element, wherein the processor controls the first and second temperature regulation elements to maintain materials of the outer protective shell and the inner protective system within temperature ranges corresponding to their respective ductile/brittle transition temperatures to preserve impact protection capabilities across varying environmental conditions.

23. The helmet system of claim 22, wherein the processor is configured to use the first temperature regulation element to produce heat based on a first temperature profile and the processor is configured to use the second temperature regulation element to produce heat based on a second temperature profile.

24. The helmet system of claim 22, wherein the first temperature regulation element and the second temperature regulation element each comprise a thermal conductive sheet.

25. The helmet system of claim 22, wherein the first temperature regulation element and the second temperature regulation element each comprise a heating means.

26. A helmet system, comprising:

an outer protective shell defining an inner cavity;

an inner protective system positioned within the inner cavity, wherein the inner protective system comprises a padding layer coupled to the outer protective shell;

a temperature regulation system, wherein the temperature regulation system comprises:

a first temperature regulation element;

a power source configured to provide electrical power to the first temperature regulation element;

a sensor configured to generate an output signal based on a sensed temperature; and a processor in communication with the sensor, wherein the processor is configured to provide electrical power to the first temperature regulation element responsive to the output signal exceeding a first temperature threshold, wherein the first temperature regulation element cools any of the inner protective system and the outer protective shell when provided with electrical power, wherein the first temperature threshold is determined based on temperature-dependent impact protection characteristics of materials in the helmet system, and wherein the temperature regulation system is configured to mitigate temperature-induced material property changes that would reduce impact protection performance.

27. A helmet system of claim 26, wherein the temperature regulation system comprises a second temperature regulation element, wherein the processor is configured to provide electrical power to the second temperature regulation element responsive to the output signal exceeding a second temperature threshold, wherein the second temperature regulation element heats any of the inner protective system and the outer protective shell when provided with electrical power.

28. A helmet system of claim 27, wherein the first temperature regulation element and the second temperature regulation element each comprise a thermoelectric cooling module.

29. A helmet system of claim 27, wherein the first temperature regulation element and the second temperature regulation element each comprise a cooling means.

30. A helmet system of claim 26, wherein the power source is tethered via flexible conductors and mountable external to the outer protective shell.

* * * * *